US009566613B2

(12) United States Patent
Kodama et al.

(10) Patent No.: US 9,566,613 B2
(45) Date of Patent: Feb. 14, 2017

(54) OSCILLATING SIEVE

(71) Applicants: Noriaki Kodama, Shizuoka (JP); Masato Kobayashi, Shizuoka (JP); Hiroshi Noaki, Shizuoka (JP); Yoshihiko Furugouri, Shizuoka (JP)

(72) Inventors: Noriaki Kodama, Shizuoka (JP); Masato Kobayashi, Shizuoka (JP); Hiroshi Noaki, Shizuoka (JP); Yoshihiko Furugouri, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 119 days.

(21) Appl. No.: 13/861,579

(22) Filed: Apr. 12, 2013

(65) Prior Publication Data

US 2013/0327685 A1 Dec. 12, 2013

(30) Foreign Application Priority Data

Jun. 7, 2012 (JP) ..... 2012-129933

(51) Int. Cl.

| | |
|---|---|
| ***B07B 1/46*** | (2006.01) |
| ***B07B 1/38*** | (2006.01) |
| ***B07B 1/55*** | (2006.01) |
| ***B07B 13/16*** | (2006.01) |

(52) U.S. Cl.

CPC . *B07B 1/38* (2013.01); *B07B 1/55* (2013.01); *B07B 13/16* (2013.01)

(58) Field of Classification Search

CPC ..... B07B 1/38; B07B 1/55; B07B 13/16; B07B 1/46; B07B 1/4609; B07B 1/4618; B07B 1/4627; B07B 1/4636; B07B 1/4645; B07B 1/4654; B07B 1/4663; B07B 1/4672; B07B 1/4681; B07B 1/469

USPC ..... 209/364, 365.1, 365.3, 381, 382, 383

See application file for complete search history.

(56) References Cited

U.S. PATENT DOCUMENTS

| | | | | |
|---|---|---|---|---|
| 5,213,216 | A * | 5/1993 | Suehiro et al. | 209/236 |
| 5,653,346 | A * | 8/1997 | Frei et al. | 209/254 |
| 5,799,799 | A * | 9/1998 | Alamzad et al. | 209/365.1 |
| 6,202,857 | B1 * | 3/2001 | Keller | B07B 1/4618 209/401 |
| 7,694,826 | B2 * | 4/2010 | Garrett et al. | 209/381 |
| 2010/0124716 | A1 | 5/2010 | Tomioka et al. | |

FOREIGN PATENT DOCUMENTS

| | | |
|---|---|---|
| JP | S52-36363 | 3/1977 |
| JP | 7-566 | 1/1995 |

(Continued)

OTHER PUBLICATIONS

Mar. 25, 2016 Japanese official action in connection with Japanese patent application No. 2012-129933.

*Primary Examiner* — Joseph C Rodriguez
*Assistant Examiner* — Kalyanavenkateshware Kumar
(74) *Attorney, Agent, or Firm* — Cooper & Dunham LLP

(57) ABSTRACT

An oscillation sieve, including a screen; an oscillator oscillating the screen to sieve a material; a feeder feeding the material onto the screen; a collector collecting the material having passed the screen; a remover removing the material not having passed the screen therefrom; a guide member fixed on the screen, guiding the material fed from the feeder and not having passed the screen to the remover, wherein the guide member is spiral member formed of an elastic material capable of following the oscillating screen.

11 Claims, 3 Drawing Sheets

(56) References Cited

FOREIGN PATENT DOCUMENTS

| | | |
|---|---|---|
| JP | 7-275801 | 10/1995 |
| JP | 11-033488 | 2/1999 |
| JP | 2001-104884 | 4/2001 |
| JP | 2002-196534 | 7/2002 |
| JP | 2004-198793 | 7/2004 |
| JP | 2005-305386 | 11/2005 |
| JP | 2006-507934 | 3/2006 |
| JP | 2007-086759 | 4/2007 |
| JP | 2008-136893 | 6/2008 |
| JP | 2010-122313 | 6/2010 |
| WO | WO2004/050263 A1 | 6/2004 |

* cited by examiner

OSCILLATING SIEVE

CROSS-REFERENCE TO RELATED APPLICATIONS

This patent application is based on and claims priority pursuant to 35 U.S.C. §119 to Japanese Patent Application No. 2012-129933, filed on Jun. 7, 2012, in the Japan Patent Office, the entire disclosure of which is hereby incorporated by reference herein.

BACKGROUND OF THE INVENTION

1. Field of the Invention

The present invention relates to an oscillator sieving a toner used in image forming apparatus and other raw materials.

2. Description of the Related Art

Methods of visualizing electrostatic latent image information such as an electrophotographic method are used in various fields. The electrophotographic method includes charging, irradiating to form an electrostatic latent image on a photoreceptor, developing the electrostatic latent image with a developer including a toner to form a toner image, and transferring and fixing the toner image. The developer includes a two-component developer formed of a toner and a carrier and a one-component developer formed of only a magnetic or non-magnetic toner. In either case, a toner is a main component. Methods of preparing a toner include dry methods such as pulverization methods; and wet methods such as emulsion polymerization agglutination methods, suspension polymerization methods, drying in liquid methods and rotational phase emulsification methods.

The dry method using the pulverization method uniformly mixing and dispersing materials such as a binder resin, a release agent, a colorant and an optional charge controlling agent with a press kneader, an extruder or a media disperser. Then, the mixed materials are collided to a target mechanically or under a jet stream such that the resultant toner has a desired particle diameter, and further classified such that the resultant toner has a sharp particle diameter distribution. The toner having a desired particle diameter is formed of a binder resin and a colorant, and further includes an inorganic particulate material as an external additive in many cases to improve its fluidity. The toner has sufficient fluidity with the externally added inorganic particulate material, and produces high-quality images without blank images. However, when the toner and the external additive are stirred and mixed, the toners agglutinate with each other or with the external additive, or the external additives agglutinate with each other due to generation of eat and collision of the materials in high-speed mixing.

Meanwhile, the wet methods have problems of aggregates of materials made in the process of emulsification, suspension and drying; and plate-shaped coarse particles caused by materials adhering to the emulsification, suspension and reaction containers, and the stirring blades.

The aggregates in the dry methods and the coarse particles in the wet methods cause a non-uniform gap between a photoreceptor and a transfer material, i.e., a transfer gap in a transfer process in image forming apparatus. The non-uniform gap causes uneven image density and toner scattering on non-image areas. A toner including the aggregates and coarse particles is likely to produce images having uneven image density caused by charge difference due to particle size difference. The aggregates and coarse particles are large elements deteriorating image quality, such as uneven image density and toner scattering on non-image areas. Further, they cause toner scattering in developing of image forming apparatus, resulting in contamination therein.

The aggregates and coarse particles made in the process of preparing a toner cause deterioration of image quality and contamination in image forming apparatus. In order to remove the aggregates and the coarse particles from a toner, conventional toner preparation processes include a sieving process sieving a toner with a sieve.

A toner including the aggregates and coarse particles is fed on a screen of the sieve having a predetermined opening diameter, and mechanical oscillation such as three-dimensional motion is applied to the screen for sieving. The oscillation sieve can separate the toner having passed the screen and the aggregates and coarse particles not having passed the screen. Japanese Patent No. JP-2840714-B1 (Japanese published unexamined application No. JP-H07-275081-A) discloses an oscillation sieve including a guide member at a coarse powder exhaust, guiding the aggregates and coarse particles thereto to be discharged. Japanese published unexamined application No. JP-H11-033488-A discloses an oscillation sieve including an exhaust inhibitor on the screen, preventing the aggregates and coarse particles remaining thereon from discharging from a coarse powder exhaust when sieving. The oscillation sieve prevents the aggregates and coarse particles from discharging from the coarse powder exhaust when sieving, and discharge them therefrom only when doing discharge operation. Japanese published unexamined application No. JP-2006-507934-A discloses an oscillation sieve including a spiral guide member guiding the aggregates and coarse particles fed to the center of a circular screen to a coarse powder exhaust on an outer circumference of the screen.

The oscillation sieves disclosed in Japanese Patent No. JP-2840714-B1 (Japanese published unexamined application No. JP-H07-275081-A), and Japanese published unexamined applications Nos. JP-H11-033488-A and JP-2006-507934-A remove the aggregates and coarse particles formed before sieving process. However, the oscillation sieve disclosed in Japanese Patent No. JP-2840714-B1 (Japanese published unexamined application No. JP-H07-275081-A) discharges even materials having a desired particle diameter, passable through the screen, resulting in lowering of yield rate.

The oscillation sieve disclosed in Japanese published unexamined application No. JP-H11-033488-A prevents materials having a desired particle diameter from flowing out to the coarse powder exhaust. When the oscillation sieve discharges nothing therefrom when sieving, the aggregates and coarse particles unpassable through the screen keep on remaining thereon. When the aggregates and coarse particles keep on remaining on the screen, their ratios on the screen are high and the screen is likely to be clogged, resulting in deterioration of sieving capability. In order to avoid this, sieving operation is switched to discharge operation at a predetermined time to discharge the aggregates and coarse particles on the screen from the coarse powder exhaust. However, sieving operation needs stopping to do discharge operation, and productivity largely deteriorates in long-time continuous operation.

In the oscillation sieve disclosed in Japanese published unexamined application No. JP-2006-507934-A, materials fed at the center of the circular screen are spirally transferred along the spiral guide member on the screen to the coarse powder exhaust formed at the outer circumference of the screen. When materials are spirally transferred, time since they are fed on the screen until discharged at the coarse powder exhaust is assured, and the aggregates and coarse particles are continuously discharged. When time since materials on the screen until discharged at the coarse powder exhaust is assured, those having a desired particle diameter passable through the screen have more opportunity to be sieved, which prevents the yield rate from lowering in the oscillation sieve disclosed in Japanese Patent No. JP-2840714-B1 (Japanese published unexamined application No. JP-H07-275081-A). In addition, materials including the aggregates and coarse particles in a large ratio are continuously discharged from the coarse powder exhaust, which prevents the ratio of the aggregates and coarse particles from increasing, the screen from being clogged, and sieving capability from deteriorating even in long-time operations. Further, sieving operation does not need stopping to do discharge operation as the oscillation sieve disclosed in Japanese published unexamined application No. JP-H11-033488-A, and large deterioration of productivity in long-time continuous operation can be prevented.

However, the oscillation sieve disclosed in Japanese published unexamined application No. JP-2006-507934-A uses a metallic member as a guide member. A high-harness guide member formed of a metal cannot follow the oscillation of the screen. The guide member is fixed on the screen with an adhesive in the oscillation sieve disclosed in Japanese published unexamined application No. JP-2006-507934-A. When a part of the guide member is fixed on the screen, a gap between the guide member which cannot follow the oscillation of the screen and the screen opens and closes at an unfixed part. Meanwhile, when the whole area of the guide member contacting the screen is fixed thereon with an adhesive, the guide member which cannot follow the oscillation of the screen is peeled from the screen, resulting in an unfixed part opening and closing a gap between the guide member and the screen. When materials enter the gap, they are repeatedly crushed therebetween to be solidified, resulting in new aggregates occasionally. In addition, when the gap between the guide member and the screen opens and closes, they are heated by friction therebetween and materials on the screen melt and agglutinate, resulting in new aggregates occasionally. The new aggregates are removed with the aggregate included in materials before sieved, resulting in lowering of yield rate.

Because of these reasons, a need exist for an oscillation sieve using a screen, which prevents its yield rate and sieving capability from lowering, and a new aggregate from generating.

SUMMARY OF THE INVENTION

Accordingly, one object of the present invention to provide an oscillation sieve using a screen, which prevents its yield rate and sieving capability from lowering, and a new aggregate from generating.

These objects and other objects of the present invention, either individually or collectively, have been satisfied by the discovery of an oscillation sieve, comprising:

a screen;

an oscillator configured to oscillate the screen to sieve a material;

a feeder configured to feed the material onto the screen;

a collector configured to collect the material having passed the screen;

a remover configured to remove the material not having passed the screen therefrom;

a guide member fixed on the screen, configured to guide the material fed from the feeder and not having passed the screen to the remover, wherein the guide member is spiral member formed of an elastic material capable of following the oscillating screen.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
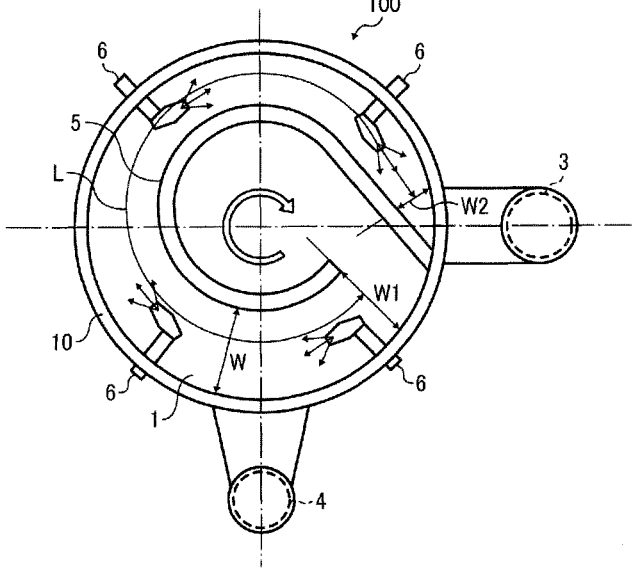
FIGS. 1A and 1B are schematic views illustrating a horizontal cross-section and a lateral side of the oscillation sieve of an embodiment of the present invention, respectively.

The present invention provides an oscillation sieve using a screen, which prevents its yield rate and sieving capability from lowering, and a new aggregate from generating.

More particularly, the present invention relates to an oscillation sieve, comprising:

a screen;

an oscillator configured to oscillate the screen to sieve a material;

a feeder configured to feed the material onto the screen;

a collector configured to collect the material having passed the screen;

a remover configured to remove the material not having passed the screen therefrom;

a guide member fixed on the screen, configured to guide the material fed from the feeder and not having passed the screen to the remover, wherein the guide member is spiral member formed of an elastic material capable of following the oscillating screen.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 1B:
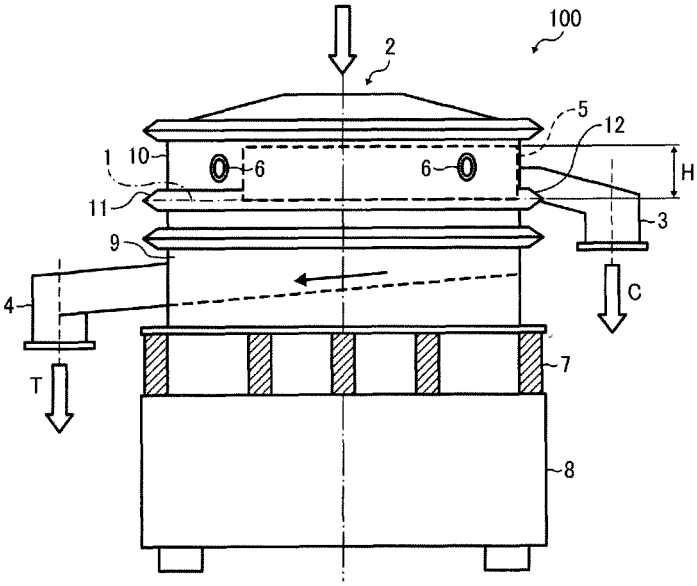

FIGS. 1A and 1B are schematic views illustrating a horizontal cross-section and a lateral side of the oscillation sieve 100 of an embodiment of the present invention, respectively.

The oscillation sieve 100 in FIG. 1 includes a base frame 8, a cylindrical under frame 9 supported by plural coil springs 7 on the base frame 8, and an upper frame 10 fixed on the under frame 9 by a V band 11. The under frame 9 includes a product exhaust 4 discharging a sieved product on an outer circumferential surface thereof, and the upper frame 10 includes a coarse powder exhaust 3 discharging a coarse powder C on an outer circumferential surface thereof. The base frame 8 includes an unillustrated oscillation motor, and the under frame 9 and the upper frame 10 on the coil springs 7 are oscillated by an unillustrated unbalance weight located on a shaft connected with the oscillation motor.

A support frame 12 is fixed between the upper frame 10 and the under frame 9, and a screen 1 is extended over the support frame 12. On the screen 1, a guide 5 is spirally located from the coarse powder exhaust 3 to the center of the screen 1 such that a material fed from a material entrance 2 is not immediately flown out to the coarse powder exhaust 3 before sieved. A whole area of the guide 5 contacting an upper surface of the screen 1 is fixed thereon. "Spirally" means that the guide 5 is away from (or approaching) the center as it circles, and the spiral can have any shapes, and preferably has an outer circumferential shape of the screen 1. Namely, the oscillation sieve 100 has the shape of a circular logarithmic spiral. The oscillation sieve 100 in FIG. 1 includes a material entrance 2 above the center of the circular screen 1, but a location placing the material on the screen 1 is not limited thereto.

The guide 5 is formed of an elastic material capable of following the oscillating screen 1 and having oscillation absorbability because a material affecting the oscillation and the amplitude of the screen 1 deteriorates sieving capability and decreases a life thereof. Specific examples thereof include natural rubbers; synthetic rubbers such as chloroprene rubbers (CR), ethylene propylene rubbers (EPDM), nitrile rubbers (NBR), silicon rubbers (Si) and fluorine-containing rubbers; foamed sponges and other foamed materials formed of the synthetic rubbers; and plastic foams such as polyurethane foams, polyethylene foams, polyolefin foams, RASK and supercritical gas foamed polyolefin foams. These materials preferably have low apparent density, low hardness and low heat conductivity and water absorbability. They preferably have an apparent density not greater than 0.4 g/cm$^2$ and a hardness not greater than 100°. The oscillation absorbing material used for the guide 5 needs to be selected in consideration of chemical resistance, heat resistance, ozone resistance, abrasion resistance, electric insulation, flame resistance, etc. of the materials to be sieved.

The guide 5 is preferably located on an upper surface of the screen 1 with a length of from 0.2 to 2.0 times of an outer circumferential length of the screen, and more preferably from 0.5 to 1.0 times thereof. When less than 0.2 times, the guide 5 is too short to keep the aggregates and coarse particles on the screen 1, and materials are possibly flown out to the coarse powder exhaust unsieved. When greater than 2.0 times, the rate of the flow channel area above the screen is so large that the screen area is small, resulting in lowering of sieving capability.

The guide 5 preferably has a height H (depth in FIG. 1A and height in FIG. 1B) of from 20 to 150 mm, and more preferably from 50 to 100 mm. When less than 20 mm, so low that the aggregates and coarse particles overleap the guide with ease and they are not kept on the screen 1, materials are possibly flown out to the coarse powder exhaust 3 unsieved. When higher than 150 mm, the weight and deflection of the guide adversely influence on the oscillation and amplitude of the screen 1, resulting in lowering of sieving capability and life shortening of the screen.

A process flow channel width W formed between an inner circumferential surface of the upper frame 10 and the guide 5 is preferably tapered from the material entrance 2 to the coarse powder exhaust 3. This can effectively use the process area of the screen 1 and sieving can efficiently be performed.

Figure 2A:
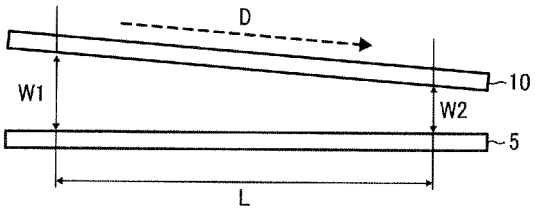
FIGS. 2A and 2B are views for explaining a case where a flow channel width decreases and a case where the flow channel width does not decrease, respectively.
Figure 2B:
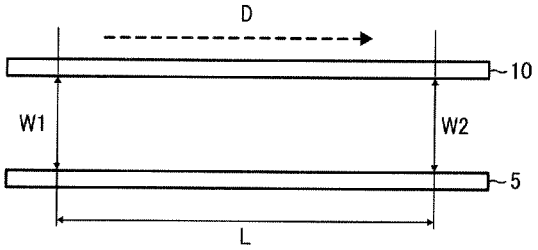

A reduction rate of the process flow channel width W (how tapered) is explained, referring to FIGS. 2A and 2B.

FIGS. 2A and 2B are views for explaining the reduction rate of the process flow channel width W.

As FIGS. 1A to 1B and 2A to 2B show, W1 is an upstream end flow channel width, W2 is a downstream end flow channel width, and L is a length of the guide 5 from a position of W1 to a position of W2. A dashed arrow D in FIGS. 2A and 2B is a transfer direction of materials to be sieved.

The reduction rate α of the process flow channel width W is determined by the following formula (1):

$$\alpha = \text{contraction amount of process flow channel width } W \text{ [mm]/guide length } L \text{ [mm]} = \text{upstream end flow channel width } W1 - \text{downstream end flow channel width } W2/\text{guide length } L \text{ [mm]} \quad (1)$$

When W1 is 100 mm, W2 is 90 mm and L is 50 mm, α=100−90/50=10/50.

When W1 is 100 mm, W2 is 100 mm and L is 50 mm as FIG. 2B shows, α=100−100/50=0/50.

The guide 5 is preferably located such the reduction rate α is from 0/50 to 10/50, and more preferably from 2/50 to 5/50. When less than 0/50, the process flow channel becomes wider toward the coarse powder exhaust 3, resulting in lowering of process area efficiency of the screen 1. It is not preferable that the exhaust flow channel becomes wider downstream than equal distance. When greater than 10/50, the process flow channel is rapidly narrowed and the aggregates and coarse particles possibly block the process flow channel. The process flow channel is gradually narrowed from the center of the screen 1 to the coarse powder exhaust 3 to increase area efficiency of the screen 1 and sieving efficiency.

As FIG. 1 shows, the upper frame 10 includes a wash nozzle 6 spraying a gas or a liquid washing medium above the screen 1 on an outer circumference thereof. The wash nozzle 6 is located so as to have a spray direction along movement locus of the aggregates and coarse particles, and washes them away and wash the upper surface of the screen 1 to prevent the mesh thereof from being clogged. The washing medium from the wash nozzle 6 is preferably a liquid having large density when the material is a liquid slurry because coarse particles are wet and have large specific gravity and adherence. When the material is a powder, the coarse powder is dry and has small specific gravity and adherence, and a gas having low density is used.

Figure 3:
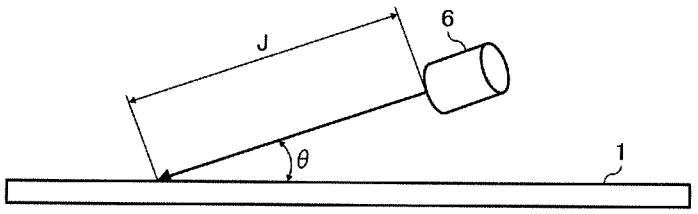
FIG. 3 is a view for explaining location of a wash nozzle for screen.

FIG. 3 is a view for explaining location of the wash nozzle 6 relative to the screen 1.

As FIG. 3 shows, a washing distance J from the wash nozzle 6 to the screen 1 is preferably from 50 to 150 mm, and more preferably from 80 to 120 mm. When less than 50 mm, the washing medium sprayed from the wash nozzle 6 has a small contact area to the screen 1, resulting in poor washing efficiency. When longer than 150 mm, the washing medium has low washing pressure to the screen 1, resulting in poor washing efficiency.

Further, as FIG. 3 shows, an angle θ between a spray direction from the wash nozzle 6 and the upper surface of the screen 1 is from 10 to 45°, and more preferably from 20 to 35°. When less than 10°, the washing medium has a small contact angle to the screen 1, resulting in poor washing efficiency. When greater than 45°, the washing medium has a small contact area to the screen 1, resulting in poor washing efficiency.

The wash nozzle 6 ideally washes the whole process flow channel, and preferably has a form having a wide washing angle such as a fan, a circle, a square and an oval. A two-fluid nozzle pulverizing and atomizing a liquid with a high-speed airflow such as compressed air and spraying fine mist at a low pressure is effectively used as well to remove coarse particles having small specific gravity and adherence.

Conventional oscillation sieves are explained.

Aggregates or coarse particles generated in the process of preparing a toner cause abnormal images, and as methods of efficiently removing these at high yield rate in the process of sieving them, induction filters and oscillation sieves have conventionally been used.

Japanese Patent No. JP-2840714-B1 (Japanese published unexamined application No. JP-H07-275081-A) discloses an oscillation sieve including a guide plate guiding aggregates and coarse particles to a coarse powder exhaust to be discharged thereat. Japanese published unexamined application No. JP-H11-033488-A discloses an oscillation sieve including an exhaust inhibitor on the screen, preventing the aggregates and coarse particles from discharging from a coarse powder exhaust when sieving, and discharging them only when doing discharge operation. Japanese published unexamined applications Nos. JP-2002-196534-A, JP-2004-198793-A and JP-2007-086759-A disclose toner preparation methods including a process of removing coarse particles in a toner slurry. Japanese published unexamined application No. JP-2006-507934-A discloses an oscillation sieve including a guide plate having an additional excitation capability preventing the screen from being clogged.

As mentioned above, the oscillation sieve disclosed in Japanese Patent No. JP-2840714-B1 (Japanese published unexamined application No. JP-H07-275081-A) discharges even materials having a desired particle diameter, passable through the screen, resulting in lowering of yield rate. The oscillation sieve disclosed in Japanese published unexamined application No. JP-H11-033488-A prevents materials having a desired particle diameter from flowing out to the coarse powder exhaust. When the oscillation sieve discharges nothing therefrom when sieving, the aggregates and coarse particles unpassable through the screen keep on remaining thereon. When the aggregates and coarse particles keep on remaining on the screen, their ratios on the screen are high and the screen is likely to be clogged, resulting in deterioration of sieving capability. In order to avoid this, sieving operation is switched to discharge operation at a predetermined time to discharge the aggregates and coarse particles on the screen from the coarse powder exhaust. However, sieving operation needs stopping to do discharge operation, and productivity largely deteriorates in long-time continuous operation.

In Japanese published unexamined application No. JP-2006-507934-A, the guide member needs to be formed of a metallic member having high oscillation transmissibility and mechanical strength because of needing to transmit oscillation energy to the screen mesh with means such as ultrasonic. Therefore, tapping at a gap between the hard guide member and the screen mesh causes flaking to the resultant product. Further, the guide member heated upon application of excitation energy such as ultrasonic causes solution or aggregation of the product.

Japanese published unexamined applications Nos. JP-2002-196534-A, JP-2004-198793-A and JP-2007-086759-A disclose a process of removing coarse particles in a toner slurry. However, the coarse particles included therein gradually clog the screen to decrease throughput, resulting in deterioration of productivity.

The oscillation sieve 100 of the present embodiment oscillates the screen 1 with an unillustrated oscillation motor to sieve an object on the screen 1. In addition, aggregates and coarse particles remaining on the screen 1 are continuously discharged from the coarse powder exhaust 3. Further, the oscillation sieve 100 includes a spiral guide 5 above the screen 1 from the material entrance 2 to the coarse powder exhaust 3, which is formed of an elastic material capable of following the oscillating screen 1. The spiral guide 5 mechanically prevents unsieved material from flowing out to the coarse powder exhaust 3, and continuously discharges the aggregates and coarse particles remaining on the screen 1. When the aggregates and coarse particles are continuously discharged, a retaining ratio thereof does not increase, clogging thereof does not occur, and the sieve does not deteriorate in capacity even when driven for long time.

The guide 5 when formed of an oscillation dampener can decay the oscillation of the screen 1, which makes materials between the guide 5 and the screen 1 difficult to tap. Further, when formed of a material having low density and low hardness, the materials are difficult to tap and flaking is not caused to the resultant product. In addition, the guide 5 when formed of a member having low heat conductivity can prevent itself from being heated upon application of excitation energy such as ultrasonic, which prevents the resultant product from aggregating.

Thus, the oscillation sieve 100 of the present embodiment solves problems such as lowering yield ratio and screen capacity, flaking of the product and generation of aggregates can stably and continuously operate for long time.

Recently, for the purpose of produce electrophotographic images having higher quality, a toner having small particle diameter for electrophotography is becoming more popular. The smaller the particle diameter, the aggregates and coarse particles included in the toner are likely to adversely affect the resultant images. Therefore, it is significant particularly for the toner having small particle diameter to remove the aggregates and coarse particles when prepared, and the oscillation sieve 100 of the present embodiment is effectively used in a sieving process of removing the aggregates and coarse particles.

Next, a case where the embodiment is used in a sieving process when a toner (for electrophotography) is prepared is explained.

First, methods and materials for preparing a toner are explained in detail.

An organic solvent composition including a binder resin and a colorant in an organic solvent or a polymerizable monomer composition including at least a polymerizable monomer and a colorant is mixed in an aqueous medium. After a shearing force is applied to the mixed liquid to prepare an emulsified or a suspension liquid, the organic solvent is removed and coarse particles in the slurry are removed by the oscillation sieve. The sieved slurry is washed and dried, and further an external additive is added thereto and mixed therein. Then, unnecessary aggregates and coarse particles are removed by the embodiment of the oscillation sieve of the present invention therefrom to prepare a toner.

First, main materials are explained.

Polyester resins are suitable as the binder resin for use in the embodiment of the present invention. Typically, polyester resins are obtained by condensation polymerization of an alcohol and a carboxylic acid. Specific examples of such alcohols include, but are not limited to, glycols such as ethylene glycol, diethylene glycol, triethylene glycol, and propylene glycol, 1,4-bis(hydroxymethyl)cyclohexane, etherified bisphenols such as bisphenol A, diol monomers, tri- or higher polyol monomers.

Specific examples of carboxylic acids include, but are not limited to, two-valent organic acid monomers such as maleic acid, fumaric acid, phthalic acid, succinic acid, and moronic acid; and tri- or higher carboxylic acid monomers such as 1,2,4-benzene tricarboxylic acid, 1,2,5-benzene tricarboxylic acid, 1,2,4-cyclohexane tricarboxylic acid, 1,2,4-naphthalene tricarboxylic acid, 1,2,5-hexane tricarboxylic acid, 1,3-dicarboxyl-2-methylene carboxy propane, and 1,2,7,8-octane tetracarboxylic acid.

Specific examples of the binder resins for use in the present invention include, but are not limited to, in addition to the polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-.alpha.-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylate resins, rosin, modified rosins, terpene resins, aliphatic or alicyclic hydrocarbon resins, aromatic petroleum resins, chlorinated paraffin, paraffin waxes, etc. These resins can be used alone or in combination.

Specific examples of the polymerizable monomers for use in the present invention include, but are not limited to, aromatic vinyl monomers such as styrene, .alpha.-styrene, p-styrene, and p-styrene, unsaturated nitriles such as acrylonitrile, unsaturated (meth)acrylates such as methyl(meth) acrylate, ethyl(meth)acrylate, butyl(meth)acrylate, ethylhexyl(meth)acrylate, lauryl(meth)acrylate, and stearyl(meth) acrylate, and conjugated diolefines such as butadiene, and isoprene. These polymerizable monomers are used alone or in combination.

The method of manufacturing coarse toner in this embodiment preferably includes a polymerization process of reacting a polyester based prepolymer having an isocyanate group dispersed in an aqueous medium containing inorganic particulates and/or polymer particulates with an amine.

A preferable prepolymer for use in this embodiment is a polyester prepolymer having an isocyanate group, which can be prepared by, for example, reacting a polyester having an active hydrogen group, which is a polycondensation product of a polyol (PO) and a polycarboxylic acid (PC), with a polyisocyanate (PIC).

Specific examples of the active hydrogen groups contained in the polyester include, but are not limited to, hydroxyl groups (alcohol hydroxyl groups and phenol hydroxyl groups), amino groups, carboxylic groups, and mercapto groups. Among these, alcohol hydroxyl groups are preferable.

Suitable polyols (PO) include, for example, diols (DIO) and polyols (TO) having three or more hydroxyl groups. Among these, a simple diol (DIO) or a mixture in which a small amount of a polyol (TO) is mixed with a diol (DIO) is preferable.

Specific examples of the diols (DIO) include, but are not limited to, alkylene glycols (e.g., ethylene glycol, 1,2-propylene glycol, 1,3-propylene glycol, 1,4-butane diol, and 1,6-hexane diol); alkylene ether glycols (e.g., diethylene glycol, triethylene glycol, dipropylene glycol, polyethylene glycol, polypropylene glycol, and polytetra methylene ether glycol); alicyclic diols (e.g., 1,4-cyclohexane dimethanol, and hydrogen added bisphenol A); bisphenols (e.g., bisphenol A, bisphenol F and bisphenol S); adducts of the alicyclic diols mentioned above with an alkylene oxide (ethylene oxide, propylene oxide and butylenes oxide); and adducts of the bisphenols mentioned above with an alkylene oxide (ethylene oxide, propylene oxide and butylenes oxide).

Among these compounds, alkylene glycols having 2 to 12 carbon atoms and adducts of a bisphenol with an alkylene oxide are preferable. Adducts of bisphenol with an alkylene oxide and mixtures of an adduct of a bisphenol with an alkylene oxide and an alkylene glycol having 2 to 12 carbon atoms are particularly preferable.

Specific examples of the polyols (TO) having three or more hydroxyl groups include, but are not limited to, glycerin, trimethylol ethane, trimethylol propane, pentaerythritol and sorbitol); polyphenols having three or more hydroxyl groups (trisphenol PA, phenol novolak and cresol novolak); and adducts of the polyphenols having three or more hydroxyl groups mentioned above with an alkylene oxide.

Specific examples of polycarboxylic acids (PC) include, but are not limited to, dicarboxylic acids (DIC) and polycarboxylic acids (TC) having three or more hydroxyl groups. Among these, a simple dicarboxylic acid (DIC) or a mixture in which a small amount of a polycarboxylic acid (TC) is mixed with a dicarboxylic acid (DIO) is preferable.

Specific examples of the dicarboxylic acids (DIC) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having 4 to 20 carbon atoms and aromatic dicarboxylic acids having 8 to 20 carbon atoms are preferably used.

Specific examples of the polycarboxylic acids (TC) having three or more hydroxyl groups include, but are not limited to, aromatic polycarboxylic acids having 9 to 20 carbon atoms (e.g., trimellitic acid and pyromellitic acid). As the polycarboxylic acid (PC), anhydrides or lower alkyl esters (e.g., methyl esters, ethyl esters or isopropyl esters) of the polycarboxylic acids mentioned above can be used for the reaction with a polyol (PO).

The suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Specific examples of the polyisocyanates (PIC) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., .α, α, α', α'-tetramethyl xylylene diisocyanate); isocyanurates; blocked polyisocyanates in which the polyisocyanates mentioned above are blocked with a phenol derivative, oxime or caprolactam; etc. These compounds can be used alone or in combination.

A suitable mixing ratio (i.e., [NCO]/[OH]) of a polyisocyanate (PIC) to a polyester resin (PE) having a hydroxyl group to obtain a polyester prepolymer having an isocyanate group is from 5/1 to 1/1, preferably from 4/1 to 1.2/1 and more preferably from 2.5/1 to 1.5/1.

The content ratio of the constitutional component of a polyisocyanate (PIC) in the polyester prepolymer having an isocyanate group at its end portion is from 0.5 to 40% by weight, preferably from 1 to 30% by weight, and more preferably from 2 to 20% by weight.

Polyamines and/or amines having an active hydrogen group are used as the amine. The active hydrogen group includes hydroxyl group and mercapto group.

Specific examples of the amines include, but are not limited to, diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine, and hexamethylene diamine); etc.

Specific examples of the polyamines (B2) having three or more amino groups include, but are not limited to, diethylene triamine, and triethylene tetramine. Specific examples of the amino alcohols (B3) include, but are not limited to, ethanol amine and hydroxyethyl aniline. Specific examples of the amino mercaptan (B4) include, but are not limited to, aminoethyl mercaptan and aminopropyl mercaptan. Specific examples of the amino acids (B5) include, but are not limited to, amino propionic acid and amino caproic acid. Specific examples of the blocked amines (B6) include, but are not limited to, ketimine compounds which are prepared by reacting one of the amines B1-B5 mentioned above with a ketone such as acetone, methyl ethyl ketone and methyl isobutyl ketone; oxazoline compounds, etc. Diamines (B1), and mixtures in which a small amount of a polyamine (B2) is mixed with a diamine (B1) are preferred.

The molecular weight of the polyester can be controlled by optionally using a molecular-weight control agent when the prepolymer reacts with the amine.

Specific examples of the molecular-weight control agent include, but are not limited to, monoamines (e.g., diethyl amine, dibutyl amine, butyl amine, and lauryl amine), and blocked amines (i.e., ketimine compounds) prepared by blocking the monoamines mentioned above. The addition amount thereof is determined depending on the molecular weight desired for a produced urea-modified polyester.

The mixing ratio of the isocyanate group to the amine, i.e., the equivalent ratio ([NCO]/[NHx]) (x is 1 or 2) of the isocyanate group [NCO] contained in the prepolymer to the amino group [NHx] contained in the amine, is normally from 1/2 to 2/1, preferably from 1.5/1 to 1/1.5 and more preferably from 1.2/1 to 1/1.2.

Suitable colorants (coloring material) for use in the toner of this embodiment include known dyes and pigments. Specific examples thereof include, but are not limited to, carbon black, Nigrosine dyes, black iron oxide, Naphthol Yellow 5, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the colorant is from 1 to 15% by weight and preferably from 3 to 12% by weight based on the toner.

In this embodiment, the colorant can be used as a master batch pigment, which is prepared by combining a colorant with a resin.

Specific examples of the binder resins for use in manufacturing the master batch or the binder resins kneaded with the master batch include, but are not limited to, the polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-.alpha.-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylate resins, rosin, modified rosins, terpene resins, aliphatic or alicyclic hydrocarbon resins, aromatic petroleum resins, chlorinated paraffin, paraffin waxes, etc. These resins can be used alone or in combination.

This master batch is typically prepared by mixing and kneading a resin and a coloring agent for the master batch upon application of high shear stress thereto. In this case, an organic solvent can be used to boost the interaction of the coloring agent with the resin.

In addition, flushing methods in which an aqueous paste including a coloring agent is mixed with a resin solution of an organic solvent to transfer the coloring agent to the resin solution and then the aqueous liquid and organic solvent are separated and removed can be preferably used because the resultant wet cake of the coloring agent can be used as it is without being dried.

In this case, a high shear dispersion device such as a three-roll mill, etc. can be preferably used for kneading the mixture.

Optionally, a releasing agent such as wax is contained together with the binder resin and the coloring agent to manufacture the toner of this embodiment of the present invention.

Any known wax as the releasing agent can be contained in the method of manufacturing toner of the present invention. Specific examples of the waxes include, but are not limited to, polyolefin waxes such as polyethylene waxes and polypropylene waxes; long chain hydrocarbons such as paraffin wax, and SASOL wax; and waxes including a carbonyl group.

Among these, preferable waxes are the waxes having a carbonyl group. Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkane acid amide such as ethylenediamine behenylamide; polyalkylamide such as trimellitic acid tristearylamide; dialkyl ketone such as distearyl ketone, etc.

Among these materials, the polyalkane acid esters are preferable.

The melting point of the wax in the present invention is from 40 to 160° C., preferably from 50 to 120° C., and more preferably from 60 to 90° C. Wax having an excessively low melting point tends to have an adverse impact on the high temperature preservation property, and wax having an excessively high melting point tends to cause cold offset during fixing at a low temperature.

The melt viscosity of the wax is preferably from 5 to 1,000 cps and more preferably from 10 to 100 cps measured at a temperature 20° C. higher than the melting point of the wax. A wax having an excessively high melt viscosity scarcely improves anti-hot offset property or low temperature fixing property.

The content of the wax in the toner is from 0 to 40% by weight and preferably from 3 to 30% by weight based on the toner.

Suitable aqueous media for use in this embodiment include water, and a mixture of water with a solvent miscible with water. Specific examples of such miscible solvent include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

The toner of this embodiment optionally contains a charge controlling agent.

Specific examples of the charge controlling agent include, but are not limited to, known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

In this embodiment, the content of the charge controlling agent is not unambiguously limited but determined depending on the kind of the binder resin, existence of optional external additives, and the method of manufacturing toner including a dispersion method. However, a preferable content of the charge controlling agent is from 0.1 to 10 parts by weight, and preferably from 0.2 to 5 parts by weight based on 100 parts of the binder resin. A content that is excessively large tends to lead to excessive charging property to the toner, which results in a decrease in the effect of the charge controlling agent, an increase in an electrostatic attraction force between a development roller and the toner, reduction of the fluidity of the development agent (toner), and a decrease in the image density.

These charge controlling agent can be melted and dispersed after melted and kneaded with the master batch and the resin, directly added to an organic solvent before dispersion and dissolution, or fixed on the surface of formed toner particles.

An external additive can be added to the toner of this embodiment to help improving the fluidity, developability, chargeability thereof. Inorganic particulates are suitably used as such an external additive.

The inorganic particulate preferably has a primary particle diameter of from 5 nm to 2,000 nm and more preferably from 5 nm to 500 nm. In addition, the specific surface area of the primary particle diameter of such inorganic particulates measured by the BET method is preferably from 20 to 500 $m^2/g$.

The content ratio of such inorganic particulates is preferably from 0.01 to 5% by weight and particularly preferably from 0.01 to 2% by weight based on the weight of toner, Specific examples of the inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, polymer particulates, such as polystyrene, methacrylate copolymers and acrylate copolymers, which are obtained by a soap-free emulsification polymerization, a suspension polymerization, or a dispersion polymerization, and polycondensation thermocuring resin particles, such as silicone, benzoguanamine and nylon, can be also used as the external additives.

The external additives such as a fluidizer can be surface-treated to improve the hydrophobic property and prevent deterioration of the fluidity characteristics and chargeability in a high humidity environment. Preferred specific examples of surface treatment agents include, but are not limited to, silane coupling agents, silyl agents, silane coupling agents having a fluorine alkyl group, organic titanate coupling agents, aluminum-based coupling agents, silicone oil, and modified-silicone oil.

As a cleaning property improver to remove a development agent remaining on an image bearing member or a primary transfer medium after transfer, stearic acid, aliphatic metal salts, for example, zinc stearate and calcium stearate, and polymer particulates manufactured by soap-free emulsification polymerization, such as polymethyl methacrylate particulates and polystyrene particulates, can be used. Such polymer particulates preferably have a relatively sharp particle size distribution and a volume average particle diameter of from 0.01 to 1 μm.

The process of manufacturing toner in this embodiment is specified in detail. The method of manufacturing toner of the present invention is not limited thereto.

<Preparation of Polyester Resin>

A polyester resin is obtained by heating a polyol (PO) and a polycarboxylic acid (PC) under the presence of a known esterification catalyst such as tetrabuthoxy titanate, dibutyltin oxide to 150 to 280° C., and removing water by evaporation under a reduced pressure, if necessary.

<Preparation of Prepolymer>

A polyester having an hydroxyl group prepared in the same manner as in the polyester specified above is reacted with a polyisocyanate (PIC) at 40 to 140° C. to obtain a polyester prepolymer (A) having an isocyanate group. A solvent is optionally used to conduct reaction of polyisocyanate (PIC). Specific examples of such solvents include, but are not limited to, the following inert with isocyanate compounds; aromatic solvents (toluene, xylene, etc.); ketones (acetone, methyl ethyl ketone, methylisobutylketone, etc.), esters (ethyl acetate); amides (dimethylformamide, dimethylacetoamide, etc.); and ethers (tetrahydrofuran, etc.).

<Preparation of Modified Polyester Resin>

The reaction between the polyester prepolymer (A) and the amine (B) can be conducted preliminarily or while being mixed with other toner composition material. When the reaction is conducted preliminarily, the amine (B) is reacted with the polyester prepolymer (A) at 0 to 140° C. to obtain a urea modified polyester resin. A solvent can be optionally used to react the polyester prepolymer (A) and the amine (B) as in the case of preparation of the polyester prepolymer (A). The usable solvents are the same as specified above.

<Process of Manufacturing Coarse Toner in Aqueous Medium>

Suitable aqueous media for use in this embodiment include water, and a mixture of water with a solvent miscible with water. Specific examples of such miscible solvents include, but are not limited to, alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

Toner particles are formed by reacting dispersion bodies formed of a polyester prepolymer (A) having an isocyanate group with an amine (B) in an aqueous medium or using a preliminarily manufactured modified polyester resin.

In a method of stably forming a dispersion body formed of a polyester resin and a polyester prepolymer (A) in an aqueous medium, toner composition material containing a polyester resin and a polyester prepolymer (A) is added in an aqueous medium followed by dispersion by mechanical shearing force. Other toner composition material such as wax and, a charge controlling agent can be mixed when the dispersion body is formed in an aqueous medium. However, it is more preferable that all the toner composition material is preliminarily mixed and then the mixture be introduced into the aqueous medium for dispersion.

In this embodiment, the other toner composition material such as wax and a charge controlling agent is mixed (added) when or after particles are formed in an aqueous medium.

<Addition of Solid Particulate Dispersion Agent>

In addition, oil droplets are uniformly dispersed in an aqueous medium by preliminarily adding solid particulates dispersion agent in the aqueous medium. The oil droplets are uniformly dispersed because the solid particulate dispersion agent is arranged on the surface of the oil droplets during dispersion, thereby preventing unification of the oil droplets. Therefore, a toner having a sharp particle size distribution is obtained.

Some of the solid particulate dispersion agents are present in a solid form (insoluble) in an aqueous medium and preferably inorganic particulates having an average particle diameter of from 0.01 to 1 μm.

Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Specific examples of the inorganic particulates include, but are not limited to, tricalcium phosphate, calcium carbonate, colloidal titanium oxide, colloidal silica and hydroxyapatite. Hydroxyapatite synthesized by reaction between sodium phosphate and calcium chloride in an aqueous medium under a basic condition is particularly preferable.

Specific examples of the dispersion agents for emulsifying and dispersing an oil phase in which toner compositions are dispersed in an aqueous medium include, but are not limited to, anionic dispersion agents, for example, alkylbenzene sulfonic acid salts, .alpha.-olefin sulfonic acid salts, and phosphoric acid salts; cationic dispersion agents, for example, amine salts (e.g., alkyl amine salts, aminoalcohol fatty acid derivatives, polyamine fatty acid derivatives and imidazoline), and quaternary ammonium salts (e.g., alkyldimethyl ammonium salts, dialkyldimethyl ammonium salts, alkyldimethyl benzyl ammonium salts, pyridinium salts, alkyl isoquinolinium salts and benzethonium chloride); nonionic dispersion agents, for example, fatty acid amide derivatives, polyhydric alcohol derivatives; and ampholytic dispersion agents, for example, alanine, dodecyldi(aminoethyl)glycin, di(octylaminoethyle)glycin, and N-alkyl-N,N-dimethylammonium betaine.

An extremely small amount of a surface active agent having a fluoroalkyl group is effective as the dispersion agent. Preferable specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl (C6-C10)sulfoneamidepropyltrimethylammonium salts, salts of perfluoroalkyl (C6-C10)-N-ethylsulfonyl glycin, monoperfluoroalkyl (C6-C16)ethylphosphates, etc.

Specific examples of the marketed products of such surface active agents having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surface active agents having a fluoroalkyl group include primary, secondary and tertiary aliphatic amino acids, aliphatic quaternary ammonium salts (for example, perfluoroalkyl (C6-C10) sulfoneamidepropyltrimethyl ammonium salts), benzalkonium salts, benzetonium chloride, pyridinium salts, and imidazolinium salts. Specific examples of commercially available products of these elements include SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Liquid droplet dispersion can be stabilized in an aqueous medium by using a polymer protection colloid.

Specific examples of such polymeric protection colloids include, but are not limited to, polymers and copolymers prepared using monomers, for example, acids (e.g., acrylic acid, methacrylic acid, .alpha.-cyanoacrylic acid, .alpha.-cyanomethacrylic acid, itaconic acid, crotonic acid, fumaric acid, maleic acid and maleic anhydride), acrylic monomers having a hydroxyl group (e.g., .beta.-hydroxyethyl acrylate, .beta.-hydroxyethyl methacrylate, .beta.-hydroxypropyl acrylate, .beta.-hydroxypropyl methacrylate, .gamma.-hydroxypropyl acrylate, .gamma.-hydroxypropyl methacrylate, 3-chloro-2-hydroxypropyl acrylate, 3-chloro-2-hydroxypropylmethacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine). In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protection colloid.

When compounds, for example, calcium phosphate, which are soluble in art acid or alkali, are used as a dispersion stabilizer, it is possible to dissolve the calcium phosphate by adding an acid, for example, hydrochloric acid, followed by washing of the resultant particles with water, to remove the calcium phosphate from the particulates. In addition, a zymolytic method can be used to remove such compounds.

Such a dispersion agent may remain on the surface of toner particles. However, the dispersion agent is preferably washed and removed after elongation and/or cross-linking reaction in terms of the charging property of toner particles.

The reaction time required for the elongation and/or cross-linking reaction is determined depending on the reactivity according to the combination of the isocyanate group structure included in a polyester prepolymer (A) and the reactivity thereof with the added amine (B) and is typically from 10 minute to 40 hours and preferably from 2 to 24 hours. The reaction temperature is from 0 to 150° C., and preferably from 40 to 98° C. Any known catalyst can be optionally used in the elongation reaction and/or cross linking reaction. Specific examples thereof include, but are not limited to, dibutyltin laurate, and dioctyltin laurate.

To remove the organic solvent from the obtained emulsification dispersion body, a method can be employed in which the entire system is gradually heated to completely evaporate and remove the organic solvent in droplets. Alternatively, a drying method can be used in which the dispersion body is sprayed in a dry atmosphere to completely evaporate and remove not only the non-water soluble organic solvent in droplets to form toner mother particles but also the remaining aqueous dispersion agent.

The dry atmosphere can be prepared by heating gases, for example, air, nitrogen, carbon dioxide and combustion gases. The temperature of the heated gases is preferred to be higher than the boiling point of the solvent having the highest boiling point among the solvents used in the dispersion.

A drying treatment that secures the quality can be completed in a short period of time by using a drying apparatus such as a spray dryer, a belt dryer or a rotary kiln.

The thus prepared coarse toner powder obtained after the drying process can be mixed with other particles of a charge control agent, a fluidizing agent, a coloring agent, etc. Such other particles can be fixed to the toner particles by applying a mechanical impact thereto to integrate the particles into the toner particles. Thus, the other particles can be prevented from being detached from the complex particles.

Specific examples of such mechanical impact application methods include, but are not limited to, methods in which a mixture is mixed by a blade rotating at a high speed and methods in which a mixture is put into a jet air to accelerate and collide the particles against each other or a collision plate.

Specific examples of such mechanical impact applicators (mixer) include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention can be used as a magnetic toner containing magnetic material. Specific examples of the magnetic material include, but are not limited to, oxidized iron such as magnetite, hematite and ferrite, metals such as iron, cobalt and nickel, or an alloyed metal thereof with aluminum, cobalt, copper, lead, magnesium, tin, zinc, antimony, beryllium, bismuth, cadmium, calcium, manganese, selenium, titanium, tungsten and vanadium, and a mixture thereof. Among these, magnetite is preferred in terms of magnetic characteristics.

These electromagnetic materials preferably have an average particle diameter of from about 0.1 to about 2 μm. The content thereof is from about 15 to about 200 parts by weight and preferably from 20 to 100 parts by weight based on 100 parts by weight of the resin component.

Hereinafter, a method of removing aggregates with the oscillation sieve 100 of the present invention is explained.

A toner slurry placed from the material entrance 2 is sieved at the center of the oscillating screen 1, and the slurry drops below the screen 1 and flows on the bottom of a slope shown by a dashed line in an under frame 9. Further, as an arrow T in FIG. 1B shows, the slurry is discharged out of the oscillation sieve 100 from the product exhaust 4 to obtain a slurry aggregates are removed from.

When aggregates of a toner slurry are removed, openings of the screen 1 depend on a particle size and shape of materials to be sieved. In this embodiment, for the purpose of removing aggregates, the screen 1 has an opening of from 200 to 300 μm larger than the toner. The screen 1 may be formed of stainless, buffed stainless, electropolished stainless or TEFLON (registered) coated stainless. The screen 1 can have typical sieve meshes such as a twill-woven mesh, a plain-woven and a ton-cap-woven mesh. The guide 5 can be formed of synthetic rubber foamed sponges such as a chloroprene rubber (CR), am ethylenepropylene rubber (EPDM), a nitrile rubber (NBR) and a silicon rubber (Si).

The aggregates appear as solid contents on the screen 1 and begins to move due to oscillation. They are gradually spheronized contacting the screen 1 and the guide 5, and transferred rolling along the inner circumferential surface of the upper frame 10 to the coarse powder exhaust 3 to be exhausted.

Since the aggregates need to move from the center to the outside, an unbalance weight preferably has a phase angle of from 45 to 60°.

When the phase angle is about 90°, the aggregates move from the outside to the center, and the coarse powder is difficult to exhaust.

Since the aggregates of the toner slurry adhering to the screen 1 are wet and have large specific gravity and adherence, the screen 1 is preferably washed with a liquid having a large specific gravity such as a surfactant and pure water.

Next, a method of removing unnecessary aggregates and coarse particles of a toner after mixed with an external additive is explained.

The oscillation sieve 100 is preferably a conventional oscillation sieve with an ultrasonic oscillator for the purpose of preventing openings from being clogged to improve productivity.

A toner placed from the material entrance 2 is sieved at the center of the oscillating screen 1, and the toner drops below the screen 1 and slides on the bottom of a slope shown by a dashed line in an under frame 9. Further, as an arrow T in FIG. 1B shows, the slurry is discharged out of the oscillation sieve 100 from the product exhaust 4 to obtain a toner aggregates are removed from.

Openings of the screen 1 depend on a particle size and shape of materials to be sieved. In this embodiment, the screen 1 has an opening of from 26 to 44 μm for the toner after mixed with an external additive. When less than 26 μm, the productivity noticeably deteriorates. When larger than 44 μm, coarse particles generated before the sieving process cannot be removed.

The screen 1 may be formed of stainless, buffed stainless, electropolished stainless or TEFLON (registered) coated stainless. The screen 1 can have typical sieve meshes such as a twill-woven mesh, a plain-woven and a ton-cap-woven mesh. The guide 5 can be formed of synthetic rubber foamed sponges such as a chloroprene rubber (CR), am ethylenepropylene rubber (EPDM), a nitrile rubber (NBR) and a silicon rubber (Si).

The coarse particles begin to move on the screen 1 due to oscillation. They are transferred rolling along the inner circumferential surface of the upper frame 10 to the coarse powder exhaust 3 to be exhausted while contacting the screen 1 and the guide 5.

Since the coarse particles need to move from the center to the outside, an unbalance weight preferably has a phase angle of from 45 to 60°. When the phase angle is about 90°, the coarse particles move from the outside to the center, and they are difficult to exhaust. Since the coarse particles of a powdery dried material such as a toner adhering to the screen 1 are dry and have small specific gravity and adherence, the screen 1 is preferably washed with a gas having a small specific gravity such as nitrogen and compressed air.

<Carrier for Two-Component Developer>

The toner of the present invention can be used as a single component development agent such as magnetic or non-magnetic toner free from a carrier, or in a two component development agent which is a mixture of a magnetic carrier and the toner.

The weight ratio of the toner to the magnetic carrier is preferably from 1/100 to 10/100. Any known material can be used as the magnetic carrier. Specific examples thereof include, but are not limited to, powder having magnetic characteristics such as iron powder, ferrite powder and nickel powder, glass beads, and material the surface of which is treated with a resin, etc. For example, iron powder, ferrite powder and magnetite powder, and magnetic resin carrier having a particle diameter of from about 20 to about 200 μm can be used. Magnetic carrier can be covered by coating material.

Specific examples of the resin powder that can be used for coating the magnetic carrier include, but are not limited to, amino resins, for example, urea-formaldehyde resins, melamine resins, benzoguanamine resins, urea resins, and polyamide resins, and epoxy resins. Other specific examples include, but are not limited to, polyvinyl or polyvinylidene resins, for example, acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins, for example, polyvinyl chloride resins, polyester resins, for example, polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers, for example, a copolymer of tetrafluoroethylene, fluorovinylidene and other monomers including no fluorine atom, silicone resins, maleic acid resins, fluorine based resins, and epoxy resins. In the case of a styrene-acryl copolymer, it is preferable to contain styrene of from 30 to 90% by weight. When the content of styrene is too small, the development characteristics easily degrade. By contrast, a content of styrene that is too large tends to harden the coated film so that the coated film is easily peeled off, which shortens the working life of the carrier. The above resin coating on the carrier in the present invention may include an adhesion applying agent, a hardener, a lubricant, a conducting agent, a charge controlling agent, etc. besides the resin.

Electroconductive powder, etc., can be optionally contained in the coating resin as the coating material. Specific examples of such electroconductive powder include, but are not limited to, metal powder, carbon blacks, titanium oxide, tin oxide, and zinc oxide. The average particle diameter of such electroconductive powder is preferably not greater than 1 μm. When the average particle diameter is within this range, the electric resistance can be suitably controlled.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Material for an oil phase such as an unmodified polyester, a prepolymer, a master batch (MB), and ketimine were prepared and the oil phase and an aqueous phase were prescribed from the material. An emulsified liquid dispersion was obtained by mixing the oil phase and the aqueous phase using a mixer having an emulsification mechanism. The emulsified liquid dispersion was subject to removal of solvent to a toner slurry. The slurry was sieved to remove coarse particles.

Each process is described below.

<Synthesis of Non-Modified Polyester>

690 parts of an adduct of bisphenol A with 2 mol of ethylene oxide and 256 parts of terephthalic acid were placed in a reaction container equipped with a condenser, a stirrer and a nitrogen introduction tube to conduct a reaction at 230° C. for 8 hours. Next, the reaction was continued for 5 hours with a reduced pressure of from 10 to 15 mmHg (1.3 to 2.0 Pa). Subsequent to cooling down to 160° C., 18 parts of phthalic anhydride was added for reaction for 2 hours to obtain [Non-modified polyester B].

<Synthesis of Prepolymer>

The following components were placed in a container equipped with a condenser, a stirrer and a nitrogen introducing tube to conduct reaction at 230° C. at normal pressure for 8 hours followed by another reaction for 5 hours with a reduced pressure of 10 to 15 mmHg (1.3 to 2.0 Pa). Subsequent to cooling down to 160° C., 32 parts of phthalic anhydride was added for reaction for 2 hours.

Adduct of bisphenol A with 2 mole of ethylene oxide: 682 parts

Adduct of bisphenol A with 2 mole of propylene oxide: Si parts

Terephthalic acid: 283 parts

Trimellitic anhydride: 22 parts

Dibutyl tin oxide: 2 parts

Subsequent to cooling down to 80° C., 230 parts of isophorone diisocyanate was added to the reaction liquid and a 2 hour reaction was conducted in ethyl acetate to obtain [Prepolymer A] containing an isocyanate group.

<Synthesis of Ketimine Compound>

In a reaction container equipped with a stirrer and a thermometer, 170 parts of isophoronediamine and 75 parts of methyl ethyl ketone were mixed to conduct reaction at 50° C. for 5 hours to obtain [Ketimine compound 1].

<Preparation of Toner Material Solution>

14.3 parts of [Prepolymer A], 55 parts of [Non-modified polyester B], and 78.6 parts of ethyl acetate were set in a tank followed by stirring for dissolution. Thereafter, 10 parts of rice wax (releasing agent: melting point: 83° C.) and 4 parts of copper phthalocyanine blue pigment were added. The solution was stirred at 60° C. by a TK HOMOMIXER at 12,000 rpm for 15 minutes followed by dispersion treatment by a bead mill at 20° C. for 60 minutes. This is determined as [Toner material solution 1].

<Preparation of Toner Slurry>

The following materials were placed in another tank to dissolve them uniformly.

Deionized water 306 parts

10% suspension of calcium triphosphate 265 parts

Dodecylbenzene sodium sulfate 0.2 parts

Then, 749 parts of [Toner material solution 1] and 2.7 parts of [Ketimine compound 1] were added thereto to conduct urea reaction while the solution was stirred at 12,000 rpm by a TK HOMOMIXER. The particle diameter and the particle size distribution were observed by an optical microscope. When the average particle diameter was greater than about 10 μm, stirring was continued for 5 more minutes at a number of stirring rotation of 14,000 rpm to obtain a liquid emulsification. Thereafter, the liquid emulsification was heated to 45° C. to remove the solvent by stirring at 10.5 m/s for the outer peripheral speed under the atmospheric pressure (101.3 kPa) for 5 hours to prepare [Toner slurry A].

The particle size of [Toner slurry A] was measured by Coulter Multisizer III to find that it had a volume-average particle diameter (Dv) of 5.34 μm, Dv/Dn (number-average particle diameter) of 1.15 and a ratio of coarse particles having a diameter not less than 25 μm of 1.2% by volume.

[Toner slurry A] was sieved by an oscillation sieve from KOWA KOGYOSHO CO., LTD. in FIG. 1, having the following specifications.

Opening of screen 1: 250 μm

Effective mesh diameter: 425 mm

Guide 5 (formed of chloroprene rubber (CR) foamed sponge having a density of 0.19 g/cm$^3$ and a hardness of 24°) height H: 50 mm Guide length L: 900 mm (0.7 times of an outer circumferential length of the screen)

Flow channel width reduction rate α 0/50

In FIG. 2B, the flow channel width W was equal to the coarse powder exhaust 3.

The toner slurry was continuously fed to the sieve at an initial flow amount of 3,000 kg/h, and a time for sieving total 2,500 (L) thereof was measured. The flow amount was controlled such that the unprocessed slurry did not overflow the guide. The sieved toner was filtered, washed, dried and mixed with silica and titanium to prepare a toner. The ratio of coarse particles having a diameter not less than 25 μm was 1.0% by volume when measured by Coulter Multisizer III. The toner was placed on an analysis sieve (53 μm) and vacuumed from underneath to visually observe flaked particles, and they were not observed. A yield ratio of the toner between the processes was 99.1%. The results are shown in Tables 1-1 to 1-3.

Example 2

The procedure for sieving Toner slurry A in Example 1 was repeated except for replacing Toner slurry A with Toner slurry B having a Dv relatively smaller than that of Toner slurry A. The results are shown in Tables 1-1 to 1-3.

Example 3

The procedure for sieving Toner slurry A in Example 1 was repeated except for replacing Toner slurry A with Toner slurry C having a Dv relatively larger than that of Toner slurry A. The results are shown in Tables 1-1 to 1-3.

Example 4

The procedure for sieving Toner slurry A in Example 1 was repeated except for changing the guide length L from 900 mm (0.7 times of an outer circumferential length of the screen) to 3,000 mm (2.2 times of an outer circumferential length of the screen). The results are shown in Tables 1-1 to 1-3.

Example 5

The procedure for sieving Toner slurry A in Example 1 was repeated except for changing the guide length L from 900 mm (0.7 times of an outer circumferential length of the screen) to 2,800 mm (2.1 times of an outer circumferential length of the screen). The results are shown in Tables 1-1 to 1-3.

Example 6

The procedure for sieving Toner slurry A in Example 1 was repeated except for changing the guide length L from 900 mm (0.7 times of an outer circumferential length of the screen) to 2,600 mm (2.0 times of an outer circumferential length of the screen). The results are shown in Tables 1-1 to 1-3.

Example 7

The procedure for sieving Toner slurry A in Example 1 was repeated except for changing the guide length L from 900 mm (0.7 times of an outer circumferential length of the screen) to 1,100 mm (0.8 times of an outer circumferential length of the screen). The results are shown in Tables 1-1 to 1-3.

Example 8

The procedure for sieving Toner slurry A in Example 1 was repeated except for changing the guide length L from 900 mm (0.7 times of an outer circumferential length of the screen) to 600 mm (0.4 times of an outer circumferential length of the screen). The results are shown in Tables 1-1 to 1-3.

Example 9

The procedure for sieving Toner slurry A in Example 1 was repeated except for changing the guide length L from 900 mm (0.7 times of an outer circumferential length of the screen) to 300 mm (0.2 times of an outer circumferential length of the screen). The results are shown in Tables 1-1 to 1-3.

Example 10

The procedure for sieving Toner slurry A in Example 1 was repeated except for changing the guide length L from 900 mm (0.7 times of an outer circumferential length of the screen) to 130 mm (0.1 times of an outer circumferential length of the screen). The results are shown in Tables 1-1 to 1-3. The toner slurry was overflowed, and right after overflowed, the flow amount of the slurry was reduced to continue sieving.

Example 11

The procedure for sieving Toner slurry A in Example 1 was repeated except for changing the guide length L from 900 mm (0.7 times of an outer circumferential length of the screen) to 60 mm (0.05 times of an outer circumferential length of the screen). The results are shown in Tables 1-1 to 1-3. The toner slurry was overflowed, and right after overflowed, the flow amount of the slurry was reduced to continue sieving.

Example 12

The procedure for sieving Toner slurry A in Example 1 was repeated except for changing the guide height H from 50 mm to 10 mm. The results are shown in Tables 1-1 to 1-3. The toner slurry was overflowed, and right after overflowed, the flow amount of the slurry was reduced to continue sieving.

Example 13

The procedure for sieving Toner slurry A in Example 1 was repeated except for changing the guide height H from 50 mm to 20 mm. The results are shown in Tables 1-1 to 1-3.

Example 14

The procedure for sieving Toner slurry A in Example 1 was repeated except for changing the guide height H from 50 mm to 80 mm. The results are shown in Tables 1-1 to 1-3.

Example 15

The procedure for sieving Toner slurry A in Example 1 was repeated except for changing the guide height H from 50 mm to 150 mm. The results are shown in Tables 1-1 to 1-3.

Example 16

The procedure for sieving Toner slurry A in Example 1 was repeated except for changing the guide height H from 50 mm to 160 mm. The results are shown in Tables 1-1 to 1-3.

Example 17

The procedure for sieving Toner slurry A in Example 1 was repeated except for changing the guide height H from 50 mm to 200 mm. The results are shown in Tables 1-1 to 1-3.

Example 18

The procedure for sieving Toner slurry A in Example 1 was repeated except for changing the flow channel width reduction rate α from 0/50 to −5/50, which gradually widened the channel. The results are shown in Tables 1-1 to 1-3.

Example 19

The procedure for sieving Toner slurry A in Example 1 was repeated except for changing the flow channel width reduction rate α from 0/50 to 2/50, which gradually narrowed the channel. The results are shown in Tables 1-1 to 1-3.

Example 20

The procedure for sieving Toner slurry A in Example 1 was repeated except for changing the flow channel width reduction rate α from 0/50 to 10/50, which gradually narrowed the channel. The results are shown in Tables 1-1 to 1-3.

Example 21

The procedure for sieving Toner slurry A in Example 1 was repeated except for changing the flow channel width reduction rate α from 0/50 to 15/50, which gradually narrowed the channel. The channel was so quickly narrowed that aggregates blocked the channel and sieving was suspended. The results are shown in Tables 1-1 to 1-3.

Example 22

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 5° and a distance J of 100 mm relative to the upper surface of the screen 1, which washed the upper surface thereof with ion-exchanged water (pure water) every 10 min at 20 L/min×0.2 Mpa. The results are shown in Tables 1-1 to 1-3.

Example 23

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 10° and a distance J of 100 mm relative to the upper surface of the screen 1, which washed the upper surface thereof with ion-exchanged water (pure water) every 10 min at 20 L/min×0.2 Mpa. The results are shown in Tables 1-1 to 1-3.

Example 24

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 45° and a distance J of 100 min relative to the upper surface of the screen 1, which washed the upper surface thereof with ion-exchanged water (pure water) every 10 min at 20 L/min×0.2 Mpa. The results are shown in Tables 1-1 to 1-3.

Example 25

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 50° and a distance J of 100 mm relative to the upper surface of the screen 1, which washed the upper surface thereof with ion-exchanged water (pure water) every 10 min at 20 L/min×0.2 Mpa. The results are shown in Tables 1-1 to 1-3.

Example 26

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 90° and a distance J of 100 mm relative to the upper surface of the screen 1, which washed the upper surface thereof with ion-exchanged water (pure water) every 10 min at 20 L/min×0.2 Mpa. The results are shown in Tables 1-1 to 1-3.

Example 27

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 20 mm relative to the upper surface of the screen 1, which washed the upper surface thereof with ion-exchanged water (pure water) every 10 min at 20 L/min×0.2 Mpa. The results are shown in Tables 1-1 to 1-3.

Example 28

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 50 mm relative to the upper surface of the screen 1, which washed the upper surface thereof with ion-exchanged water (pure water) every 10 min at 20 L/min×0.2 Mpa. The results are shown in Tables 1-1 to 1-3.

Example 29

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 150 mm relative to the upper surface of the screen 1, which washed the upper surface thereof with ion-exchanged water (pure water) every 10 min at 20 L/min×0.2 Mpa. The results are shown in Tables 1-1 to 1-3.

Example 30

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 200 mm relative to the upper surface of the screen 1, which washed the upper surface thereof with ion-exchanged water (pure water) every 10 min at 20 L/min×0.2 Mpa. The results are shown in Tables 1-1 to 1-3.

Example 31

The procedure for sieving Toner slurry A in Example 1 was repeated except for changing the flow channel width reduction rate α from 0/50 to 2/50, which gradually narrowed the channel, and locating 4 nozzles 6 on an outer circumference of the upper frame 10 at an angle θ of 20° and a distance 7 of 100 mm relative to the upper surface of the screen 1, which washed the upper surface thereof with ion-exchanged water (pure water) every 10 min at 20 L/min×0.2 Mpa. The results are shown in Tables 1-1 to 1-3.

Comparative Example 1

The procedure for sieving Toner slurry A in Example 1 was repeated except for excluding the guide 5. The results are shown in Tables 1-1 to 1-3.

Comparative Example 2

Figure 4A:
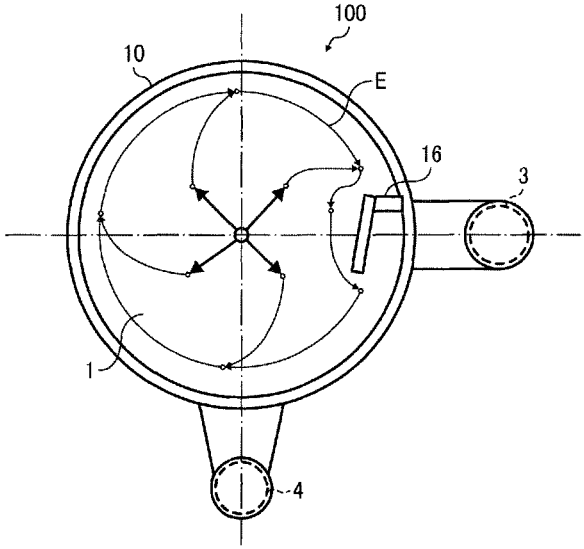
FIGS. 4A and 4B are schematic views illustrating a horizontal cross-section of the oscillation sieve in Comparative Examples 2 and 5 in normal operation and discharge operation, respectively.
Figure 4B:
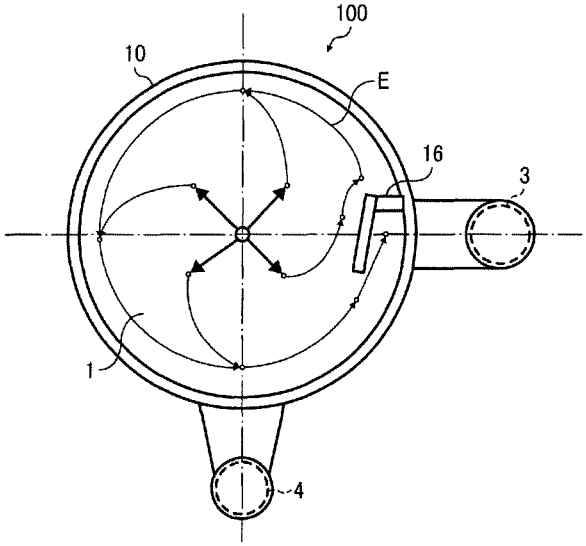

FIGS. 4A and 4B are schematic views illustrating a horizontal cross-section of the oscillation sieve in Comparative Example 2, which are a little above the screen 1. FIG. 4A is an explanatory view of normal operation and FIG. 4B is an explanatory view of discharge operation. An arrow E on the screen 1 represents a moving direction of a material (including a coarse powder and coarse particles) not having passed the screen 1. In normal operation, since the material on the screen 1 moves clockwise from the center to the outer circumference, an exhaust blocking plate 16 near an upstream side of clockwise direction relative to the coarse powder exhaust 3 prevents the material from discharging therefrom. The exhaust blocking plate 16 is open at a downstream side of clockwise direction relative to the coarse powder exhaust 3. As FIG. 4B shows, in discharge operation, since the material on the screen 1 moves anti-clockwise from the center to the outer circumference, the material moves to the coarse powder exhaust 3 from the open part of the exhaust blocking plate 16 to be discharged.

The procedure for sieving Toner slurry A in Comparative Example 1 was repeated except for locating the exhaust blocking plate 16 in Comparative Example 2. Since the exhaust blocking plate 16 prevents a material from discharging from the coarse powder exhaust 3 in normal operation, possibility of aggregation of the material on the screen 1 increases as time passes. Therefore, every time when performing normal operation for 3 min, a reverse operation is performed and a travel direction of the aggregates is reversed to discharge coarse particles on the screen 1 from the coarse powder exhaust 3. The results are shown in Tables 1-1 to 1-3.

Comparative Example 3

The procedure for sieving Toner slurry A in Example 1 was repeated except for replacing the guide 5 with a guide 5 formed of a stainless metal member and adding a mechanism receiving an ultrasonic excitation energy thereto, changing the guide length L from 900 mm (0.7 times of an outer circumferential length of the screen) to 600 mm (0.4 times of an outer circumferential length of the screen) and the flow channel width reduction rate α from 0/50 to −5/50. The guide 4 had a surface temperature of 19.3° C. before operation and a temperature of 35.2° C. during the operation. The results are shown in Tables 1-1 to 1-3.

TABLE 1-1

| | Toner Properties | | | | |
|---|---|---|---|---|---|
| | Slurry | Dv (μm) | Dv/Dn | 25 μm or more particle rate (Vol %) | Initial flow Amount (kg/h) |
| Example 1 | A | 5.34 | 1.15 | 1.2 | 3,000 |
| Example 2 | B | 5.14 | 1.19 | 0.6 | 3,000 |
| Example 3 | C | 6.30 | 1.18 | 2.1 | 3,000 |
| Example 4 | A | 5.34 | 1.15 | 1.2 | 3,000 |
| Example 5 | A | 5.34 | 1.15 | 1.2 | 3,000 |
| Example 6 | A | 5.34 | 1.15 | 1.2 | 3,000 |
| Example 7 | A | 5.34 | 1.15 | 1.2 | 3,000 |
| Example 8 | A | 5.34 | 1.15 | 1.2 | 3,000 |
| Example 9 | A | 5.34 | 1.15 | 1.2 | 3,000 |
| Example 10 | A | 5.34 | 1.15 | 1.2 | 3,000 |
| Example 11 | A | 5.34 | 1.15 | 1.2 | 3,000 |
| Example 12 | A | 5.34 | 1.15 | 1.2 | 3,000 |
| Example 13 | A | 5.34 | 1.15 | 1.2 | 3,000 |
| Example 14 | A | 5.34 | 1.15 | 1.2 | 3,000 |
| Example 15 | A | 5.34 | 1.15 | 1.2 | 3,000 |
| Example 16 | A | 5.34 | 1.15 | 1.2 | 3,000 |
| Example 17 | A | 5.34 | 1.15 | 1.2 | 3,000 |
| Example 18 | A | 5.34 | 1.15 | 1.2 | 3,000 |
| Example 19 | A | 5.34 | 1.15 | 1.2 | 3,000 |
| Example 20 | A | 5.34 | 1.15 | 1.2 | 3,000 |
| Example 21 | A | 5.34 | 1.15 | 1.2 | 3,000 |
| Example 22 | A | 5.34 | 1.15 | 1.2 | 3,000 |
| Example 23 | A | 5.34 | 1.15 | 1.2 | 3,000 |
| Example 24 | A | 5.34 | 1.15 | 1.2 | 3,000 |
| Example 25 | A | 5.34 | 1.15 | 1.2 | 3,000 |
| Example 26 | A | 5.34 | 1.15 | 1.2 | 3,000 |
| Example 27 | A | 5.34 | 1.15 | 1.2 | 3,000 |
| Example 28 | A | 5.34 | 1.15 | 1.2 | 3,000 |
| Example 29 | A | 5.34 | 1.15 | 1.2 | 3,000 |
| Example 30 | A | 5.34 | 1.15 | 1.2 | 3,000 |
| Example 31 | A | 5.34 | 1.15 | 1.2 | 3,000 |
| Comparative Example 1 | A | 5.34 | 1.15 | 1.2 | 3,000 |
| Comparative Example 2 | A | 5.34 | 1.15 | 1.2 | 3,000 |
| Comparative Example 3 | A | 5.34 | 1.15 | 1.2 | 3,000 |

TABLE 1-2

| | Guide length (mm) | Screen outer circumference times | Guide height (mm) | Flow channel width reduction rate (mm) | Washing nozzle angle (°) | Washing nozzle distance (mm) |
|---|---|---|---|---|---|---|
| Example 1 | 900 | 0.7 | 50 | 0/50 | — | — |
| Example 2 | 900 | 0.7 | 50 | 0/50 | — | — |
| Example 3 | 900 | 0.7 | 50 | 0/50 | — | — |
| Example 4 | 3,000 | 2.2 | 50 | 0/50 | — | — |
| Example 5 | 2,800 | 2.1 | 50 | 0/50 | — | — |
| Example 6 | 2,600 | 2.0 | 50 | 0/50 | — | — |
| Example 7 | 1,100 | 0.8 | 50 | 0/50 | — | — |
| Example 8 | 600 | 0.4 | 50 | 0/50 | — | — |
| Example 9 | 300 | 0.2 | 50 | 0/50 | — | — |
| Example 10 | 130 | 0.1 | 50 | 0/50 | — | — |
| Example 11 | 60 | 0.05 | 50 | 0/50 | — | — |
| Example 12 | 900 | 0.7 | 10 | 0/50 | — | — |
| Example 13 | 900 | 0.7 | 20 | 0/50 | — | — |

TABLE 1-2-continued

| | Guide length (mm) | Screen outer circumference times | Guide height (mm) | Flow channel width reduction rate (mm) | Washing nozzle angle (°) | Washing nozzle distance (mm) |
|---|---|---|---|---|---|---|
| Example 14 | 900 | 0.7 | 80 | 0/50 | — | — |
| Example 15 | 900 | 0.7 | 150 | 0/50 | — | — |
| Example 16 | 900 | 0.7 | 160 | 0/50 | — | — |
| Example 17 | 900 | 0.7 | 200 | 0/50 | — | — |
| Example 18 | 900 | 0.7 | 50 | −5/50 | — | — |
| Example 19 | 900 | 0.7 | 50 | 2/50 | — | — |
| Example 20 | 900 | 0.7 | 50 | 10/50 | — | — |
| Example 21 | 900 | 0.7 | 50 | 15/50 | — | — |
| Example 22 | 900 | 0.7 | 50 | 2/50 | 5 | 100 |
| Example 23 | 900 | 0.7 | 50 | 2/50 | 10 | 100 |
| Example 24 | 900 | 0.7 | 50 | 2/50 | 45 | 100 |
| Example 25 | 900 | 0.7 | 50 | 2/50 | 50 | 100 |
| Example 26 | 900 | 0.7 | 50 | 2/50 | 90 | 100 |
| Example 27 | 900 | 0.7 | 50 | 2/50 | 20 | 20 |
| Example 28 | 900 | 0.7 | 50 | 2/50 | 20 | 50 |
| Example 29 | 900 | 0.7 | 50 | 2/50 | 20 | 150 |
| Example 30 | 900 | 0.7 | 50 | 2/50 | 20 | 200 |
| Example 31 | 900 | 0.7 | 50 | 2/50 | 20 | 100 |
| Comparative Example 1 | — | — | — | — | — | — |
| Comparative Example 2 | — | — | — | — | — | — |
| Comparative Example 3 | 600 | 0.4 | 50 | −5/50 | — | — |

TABLE 1-3

| | Coarse particle retention time (sec) | Overflow | Yield rate between processes (%) | Process time (min) | 25 μm or more particle rate (Vol %) | Flaking (visual) |
|---|---|---|---|---|---|---|
| Example 1 | 73 | None | 99.1 | 72 | 1.0 | None |
| Example 2 | 70 | None | 99.2 | 72 | 0.5 | None |
| Example 3 | 86 | None | 98.8 | 74 | 1.4 | None |
| Example 4 | 600 | None | 99.1 | 300 | 1.2 | None |
| Example 5 | 351 | None | 99.1 | 150 | 0.8 | None |
| Example 6 | 150 | None | 99.1 | 90 | 1.1 | None |
| Example 7 | 110 | None | 99.1 | 73 | 1.1 | None |
| Example 8 | 100 | None | 98.5 | 77 | 1.2 | None |
| Example 9 | 90 | None | 98.0 | 76 | 1.2 | None |
| Example 10 | 40 | Yes | 82.0 | 91 | 1.1 | None |
| Example 11 | 25 | Yes | 80.0 | 97 | 1.1 | None |
| Example 12 | 75 | Yes | 90.1 | 95 | 1.0 | None |
| Example 13 | 76 | None | 99.5 | 74 | 1.2 | None |
| Example 14 | 74 | None | 99.8 | 73 | 1.1 | None |
| Example 15 | 76 | None | 99.8 | 74 | 1.2 | None |
| Example 16 | 150 | None | 99.8 | 90 | 1.3 | None |
| Example 17 | 180 | None | 99.8 | 93 | 1.2 | None |
| Example 18 | 90 | None | 98.5 | 93 | 1.2 | None |
| Example 19 | 78 | None | 99.9 | 73 | 1.3 | None |
| Example 20 | 79 | None | 99.3 | 79 | 1.0 | None |
| Example 21 | 80 | None | — | — | 1.1 | None |
| Example 22 | 77 | None | 99.8 | 68 | 1.3 | None |
| Example 23 | 74 | None | 99.6 | 48 | 1.1 | None |
| Example 24 | 73 | None | 99.8 | 47 | 1.1 | None |
| Example 25 | 78 | None | 99.3 | 67 | 1.1 | None |
| Example 26 | 79 | None | 99.7 | 69 | 1.0 | None |
| Example 27 | 76 | None | 99.8 | 63 | 1.3 | None |
| Example 28 | 73 | None | 99.6 | 47 | 1.2 | None |
| Example 29 | 74 | None | 99.8 | 46 | 1.1 | None |
| Example 30 | 78 | None | 99.8 | 65 | 1.2 | None |
| Example 31 | 65 | None | 99.9 | 42 | 1.3 | None |
| Comparative Example 1 | 15 | Yes | 70.0 | 111 | 1.2 | None |
| Comparative Example 2 | 302 | None | 98.1 | 436 | 1.1 | None |
| Comparative Example 3 | 83 | None | 96.0 | 93 | 4.5 | Yes |

Example 32

A toner slurry was prepared as Example 1. Then, the slurry was filtered, washed and dried to prepare mother particles A.

<Preparation o Toner>

1.0 parts of hydrophobic silica and 100 parts of the thus obtained mother particles were placed in a super mixer (manufactured by Kawata Mfg. Co., Ltd). The super mixer was operated at 1,100 rpm for 60 seconds followed by an intermission of 60 seconds and 1,300 rpm for 120 seconds followed by an intermission of 60 seconds. Then, 0.7 parts of hydrophobic titanium oxide was introduced to the super mixer and mixed at 1,100 rpm and 1,300 rpm with intermissions in the same manner as described above. Again, 1.0 part of hydrophobic titanium oxide was introduced and mixed at 1,000 rpm for 60 seconds followed by an intermission of 60 seconds and 1,100 rpm for 60 seconds followed by an intermission of 60 seconds to obtain [Toner A].

The particle size of [Toner A] was measured by Coulter Multisizer III to find that it had a volume-average particle diameter (Dv) of 5.39 μm, Dv/Dn (number-average particle diameter) of 1.17 and a ratio of coarse particles having a diameter not less than 25 μm of 1.2% by volume.

[Toner A] was sieved by an oscillation sieve from KOWA KOGYOSHO CO., LTD. in FIG. 1, having the following specifications.

Opening of screen 1: 34 μm

Effective mesh diameter: 425 mm

Guide 5 (formed of chloroprene rubber (CR) foamed sponge having a density of 0.19 g/cm$^3$ and a hardness of 24°) height H: 50 mm Guide length L: 900 mm (0.7 times of an outer circumferential length of the screen)

Flow channel width reduction rate α 0/50

The channel width was equal to the coarse powder exhaust 3.

The toner was continuously fed to the sieve at an initial feed amount of 20 kg/h, and a time for sieving total 30 kg thereof was measured. The feed amount was controlled such that the unprocessed toner did not overflow the guide. The sieved toner was filtered, washed, dried and mixed with silica and titanium to prepare a toner. The ratio of coarse particles having a diameter not less than 25 μm was 1.1% by volume when measured by Coulter Multisizer III. The toner was placed on an analysis sieve (53 μm) and vacuumed from underneath to visually observe flaked particles, and they were not observed. A yield ratio of the toner between the processes was 99.3%. The results are shown in Tables 2-1 to 2-3.

Example 33

The procedure for sieving Toner A in Example 32 was repeated except for replacing Toner A with Toner B having a Dv relatively smaller than that of Toner A. The results are shown in Tables 2-1 to 2-3.

Example 34

The procedure for sieving Toner A in Example 32 was repeated except for replacing Toner A with Toner C having a Dv relatively larger than that of Toner A. The results are shown in Tables 2-1 to 2-3.

Example 35

The procedure for sieving Toner A in Example 32 was repeated except for changing the guide length L from 900 mm (0.7 times of an outer circumferential length of the screen) to 3,000 mm (2.2 times of an outer circumferential length of the screen). The results are shown in Tables 2-1 to 2-3.

Example 36

The procedure for sieving Toner A in Example 32 was repeated except for changing the guide length L from 900 mm (0.7 times of an outer circumferential length of the screen) to 2,800 mm (2.1 times of an outer circumferential length of the screen). The results are shown in Tables 2-1 to 2-3.

Example 37

The procedure for sieving Toner A in Example 32 was repeated except for changing the guide length L from 900 mm (0.7 times of an outer circumferential length of the screen) to 2,600 mm (2.0 times of an outer circumferential length of the screen). The results are shown in Tables 2-1 to 2-3.

Example 38

The procedure for sieving Toner A in Example 32 was repeated except for changing the guide length L from 900 mm (0.7 times of an outer circumferential length of the screen) to 1,100 mm (0.8 times of an outer circumferential length of the screen). The results are shown in Tables 2-1 to 2-3.

Example 39

The procedure for sieving Toner A in Example 32 was repeated except for changing the guide length L from 900 mm (0.7 times of an outer circumferential length of the screen) to 600 mm (0.4 times of an outer circumferential length of the screen). The results are shown in Tables 2-1 to 2-3.

Example 40

The procedure for sieving Toner A in Example 32 was repeated except for changing the guide length L from 900 mm (0.7 times of an outer circumferential length of the screen) to 300 mm (0.2 times of an outer circumferential length of the screen). The results are shown in Tables 2-1 to 2-3.

Example 41

The procedure for sieving Toner A in Example 32 was repeated except for changing the guide length L from 900 mm (0.7 times of an outer circumferential length of the screen) to 130 mm (0.1 times of an outer circumferential length of the screen). The results are shown in Tables 2-1 to 2-3. The toner was overflowed, and right after overflowed, the feed amount of the toner was reduced to continue sieving.

Example 42

The procedure for sieving Toner A in Example 32 was repeated except for changing the guide length L from 900 mm (0.7 times of an outer circumferential length of the screen) to 60 mm (0.05 times of an outer circumferential length of the screen). The results are shown in Tables 2-1 to 2-3. The toner was overflowed, and right after overflowed, the feed amount of the toner was reduced to continue sieving.

Example 43

The procedure for sieving Toner A in Example 32 was repeated except for changing the guide height H from 50 mm to 10 mm. The results are shown in Tables 2-1 to 2-3.

Example 44

The procedure for sieving Toner A in Example 32 was repeated except for changing the guide height H from 50 mm to 20 mm. The results are shown in Tables 2-1 to 2-3.

Example 45

The procedure for sieving Toner A in Example 32 was repeated except for changing the guide height H from 50 mm to 80 mm. The results are shown in Tables 1-1 to 1-3.

Example 46

The procedure for sieving Toner A in Example 32 was repeated except for changing the guide height H from 50 mm to 150 mm. The results are shown in Tables 2-1 to 2-3.

Example 47

The procedure for sieving Toner A in Example 32 was repeated except for changing the guide height H from 50 mm to 160 mm. The results are shown in Tables 2-1 to 2-3.

Example 48

The procedure for sieving Toner in Example 32 was repeated except for changing the guide height H from 50 mm to 200 mm. The results are shown in Tables 2-1 to 2-3.

Example 49

The procedure for sieving Toner A in Example 32 was repeated except for changing the flow channel width reduction rate $\alpha$ from 0/50 to −5/50, which gradually widened the channel. The results are shown in Tables 2-1 to 2-3.

Example 50

The procedure for sieving Toner A in Example 32 was repeated except for changing the flow channel width reduction rate $\alpha$ from 0/50 to 2/50, which gradually narrowed the channel. The results are shown in Tables 2-1 to 2-3.

Example 51

The procedure for sieving Toner A in Example 32 was repeated except for changing the flow channel width reduction rate $\alpha$ from 0/50 to 10/50, which gradually narrowed the channel. The results are shown in Tables 2-1 to 2-3.

Example 52

The procedure for sieving Toner A in Example 32 was repeated except for changing the flow channel width reduction rate $\alpha$ from 0/50 to 15/50, which gradually narrowed the channel. The channel was so quickly narrowed that aggregates blocked the channel and sieving was suspended. The results are shown in Tables 2-1 to 2-3.

Example 53

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 5" and a distance 3 of 100 mm relative to the upper surface of the screen 1, which washed the upper surface thereof with compressed air every 10 min at 0.8 $m^3N/min \times 0.5$ Mpa. The results are shown in Tables 2-1 to 2-3.

Example 54

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 10° and a distance J of 100 mm relative to the upper surface of the screen 1, which washed the upper surface thereof with compressed air every 10 min at 0.8 $m^3N/min \times 0.5$ Mpa. The results are shown in Tables 2-1 to 2-3.

Example 55

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 45° and a distance J of 100 mm relative to the upper surface of the screen 1, which washed the upper surface thereof with compressed air every 10 min at 0.8 $m^3N/min \times 0.5$ Mpa. The results are shown in Tables 2-1 to 2-3.

Example 56

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 50° and a distance J of 100 mm relative to the upper surface of the screen 1, which washed the upper surface thereof with compressed air every 10 min at 0.8 $m^3N/min \times 0.5$ Mpa. The results are shown in Tables 2-1 to 2-3.

Example 57

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 90° and a distance J of 100 mm relative to the upper surface of the screen 1, which washed the upper surface thereof with compressed air every 10 min at 0.8 $m^3N/min \times 0.5$ Mpa. The results are shown in Tables 2-1 to 2-3.

Example 58

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 20 mm relative to the upper surface of the screen 1, which washed the upper surface thereof with compressed air every 10 min at 0.8 $m^3N/min \times 0.5$ Mpa. The results are shown in Tables 2-1 to 2-3.

Example 59

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 50 mm relative to the upper surface of the screen 1, which washed the upper surface thereof with compressed air every 10 min at 0.8 $m^3N/min \times 0.5$ Mpa. The results are shown in Tables 2-1 to 2-3.

Example 60

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 150 mm relative to the upper surface of the screen 1, which washed the upper surface thereof with compressed air every 10 min at 0.8 $m^3N/min \times 0.5$ Mpa. The results are shown in Tables 2-1 to 2-3.

Example 61

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 200 mm relative to the upper surface of the screen 1, which washed the upper surface thereof with compressed air every 10 min at 0.8 $m^3N/min \times 0.5$ Mpa. The results are shown in Tables 2-1 to 2-3.

Example 62

The procedure for sieving Toner A in Example 32 was repeated except for changing the flow channel width reduction rate α from 0/50 to 2/50, which gradually narrowed the channel, and locating 4 nozzles 6 on an outer circumference of the upper frame 10 at an angle θ of 20° and a distance J of 100 mm relative to the upper surface of the screen 1, which washed the upper surface thereof with compressed air every 10 min at 0.8 $m^3N/min \times 0.5$ Mpa. The results are shown in Tables 2-1 to 2-3.

Comparative Example 4

The procedure for sieving Toner A in Example 32 was repeated except for excluding the guide 5. The results are shown in Tables 2-1 to 2-3.

Comparative Example 5

The same oscillation sieve having the horizontal cross-sections in FIGS. 4A and 4B was used as in Comparative Example 2. The procedure for sieving Toner A in Comparative Example 4 was repeated except for locating the exhaust blocking plate 16 in Comparative Example 4. Since the exhaust blocking plate 16 prevents a material from discharging from the coarse powder exhaust 3 in normal operation, possibility of aggregation of the material on the screen 1 increases as time passes. Therefore, every time when performing normal operation for 3 min, a reverse operation is performed and a travel direction of the aggregates is reversed to discharge coarse particles on the screen 1 from the coarse powder exhaust 3. The results are shown in Tables 2-1 to 2-3.

Comparative Example 6

The procedure for sieving Toner A in Example 32 was repeated except for replacing the guide 5 with a guide 5 formed of a stainless metal member and adding a mechanism receiving an ultrasonic excitation energy thereto, changing the guide length L from 900 mm (0.7 times of an outer circumferential length of the screen) to 600 mm (0.4 times of an outer circumferential length of the screen) and the flow channel width reduction rate α from 0/50 to 5/50. The guide 4 had a surface temperature of 19.3° C. before operation and a temperature of 40.3° C. during the operation. The results are shown in Tables 2-1 to 2-3.

TABLE 2-1

| | Toner Properties | | | | |
|---|---|---|---|---|---|
| | Slurry | Dv (μm) | Dv/Dn | 25 μm or more particle rate (Vol %) | Feed Amount (kg/h) |
| Example 32 | A | 5.39 | 1.17 | 1.2 | 20 |
| Example 33 | B | 5.10 | 1.19 | 0.6 | 20 |
| Example 34 | C | 6.30 | 1.18 | 2.1 | 20 |
| Example 35 | A | 5.39 | 1.17 | 1.2 | 20 |
| Example 36 | A | 5.39 | 1.17 | 1.2 | 20 |
| Example 37 | A | 5.39 | 1.17 | 1.2 | 20 |
| Example 38 | A | 5.39 | 1.17 | 1.2 | 20 |
| Example 39 | A | 5.39 | 1.17 | 1.2 | 20 |
| Example 40 | A | 5.39 | 1.17 | 1.2 | 20 |
| Example 41 | A | 5.39 | 1.17 | 1.2 | 20 |
| Example 42 | A | 5.39 | 1.17 | 1.2 | 20 |
| Example 43 | A | 5.39 | 1.17 | 1.2 | 20 |
| Example 44 | A | 5.39 | 1.17 | 1.2 | 20 |
| Example 45 | A | 5.39 | 1.17 | 1.2 | 20 |
| Example 46 | A | 5.39 | 1.17 | 1.2 | 20 |
| Example 47 | A | 5.39 | 1.17 | 1.2 | 20 |
| Example 48 | A | 5.39 | 1.17 | 1.2 | 20 |
| Example 49 | A | 5.39 | 1.17 | 1.2 | 20 |
| Example 50 | A | 5.39 | 1.17 | 1.2 | 20 |
| Example 51 | A | 5.39 | 1.17 | 1.2 | 20 |
| Example 52 | A | 5.39 | 1.17 | 1.2 | 20 |
| Example 53 | A | 5.39 | 1.17 | 1.2 | 20 |
| Example 54 | A | 5.39 | 1.17 | 1.2 | 20 |
| Example 55 | A | 5.39 | 1.17 | 1.2 | 20 |
| Example 56 | A | 5.39 | 1.17 | 1.2 | 20 |
| Example 57 | A | 5.39 | 1.17 | 1.2 | 20 |
| Example 58 | A | 5.39 | 1.17 | 1.2 | 20 |
| Example 59 | A | 5.39 | 1.17 | 1.2 | 20 |
| Example 60 | A | 5.39 | 1.17 | 1.2 | 20 |
| Example 61 | A | 5.39 | 1.17 | 1.2 | 20 |
| Example 62 | A | 5.39 | 1.17 | 1.2 | 20 |
| Comparative Example 4 | A | 5.39 | 1.17 | 1.2 | 20 |
| Comparative Example 5 | A | 5.39 | 1.17 | 1.2 | 20 |
| Comparative Example 6 | A | 5.39 | 1.17 | 1.2 | 20 |

TABLE 2-2

| | Guide length (mm) | Screen outer circumference times | Guide height (mm) | Flow channel width reduction rate (mm) | Washing nozzle angle (°) | Washing nozzle distance (mm) |
|---|---|---|---|---|---|---|
| Example 32 | 900 | 0.7 | 50 | 0/50 | — | — |
| Example 33 | 900 | 0.7 | 50 | 0/50 | — | — |
| Example 34 | 900 | 0.7 | 50 | 0/50 | — | — |
| Example 35 | 3,000 | 2.2 | 50 | 0/50 | — | — |
| Example 36 | 2,800 | 2.1 | 50 | 0/50 | — | — |
| Example 37 | 2,600 | 2.0 | 50 | 0/50 | — | — |
| Example 38 | 1,100 | 0.8 | 50 | 0/50 | — | — |
| Example 39 | 600 | 0.4 | 50 | 0/50 | — | — |
| Example 40 | 300 | 0.2 | 50 | 0/50 | — | — |
| Example 41 | 130 | 0.1 | 50 | 0/50 | — | — |
| Example 42 | 60 | 0.05 | 50 | 0/50 | — | — |
| Example 43 | 900 | 0.7 | 10 | 0/50 | — | — |
| Example 44 | 900 | 0.7 | 20 | 0/50 | — | — |
| Example 45 | 900 | 0.7 | 80 | 0/50 | — | — |
| Example 46 | 900 | 0.7 | 150 | 0/50 | — | — |
| Example 47 | 900 | 0.7 | 160 | 0/50 | — | — |
| Example 48 | 900 | 0.7 | 200 | 0/50 | — | — |
| Example 49 | 900 | 0.7 | 50 | −5/50 | — | — |
| Example 50 | 900 | 0.7 | 50 | 2/50 | — | — |
| Example 51 | 900 | 0.7 | 50 | 10/50 | — | — |
| Example 52 | 900 | 0.7 | 50 | 15/50 | — | — |
| Example 53 | 900 | 0.7 | 50 | 2/50 | 5 | 100 |
| Example 54 | 900 | 0.7 | 50 | 2/50 | 10 | 100 |
| Example 55 | 900 | 0.7 | 50 | 2/50 | 45 | 100 |
| Example 56 | 900 | 0.7 | 50 | 2/50 | 50 | 100 |
| Example 57 | 900 | 0.7 | 50 | 2/50 | 90 | 100 |
| Example 58 | 900 | 0.7 | 50 | 2/50 | 20 | 20 |
| Example 59 | 900 | 0.7 | 50 | 2/50 | 20 | 50 |
| Example 60 | 900 | 0.7 | 50 | 2/50 | 20 | 150 |
| Example 61 | 900 | 0.7 | 50 | 2/50 | 20 | 200 |
| Example 62 | 900 | 0.7 | 50 | 2/50 | 20 | 100 |
| Comparative Example 4 | — | — | — | — | — | — |
| Comparative Example 5 | — | — | — | — | — | — |
| Comparative Example 6 | 600 | 0.4 | 50 | −5/50 | — | — |

TABLE 2-3

| | Coarse particle retention time (sec) | Overflow | Yield rate between processes (%) | Process time (min) | 25 μm or more particle rate (Vol %) | Flaking (visual) |
|---|---|---|---|---|---|---|
| Example 32 | 52 | None | 99.3 | 95 | 1.1 | None |
| Example 33 | 49 | None | 99.5 | 95 | 0.5 | None |
| Example 34 | 66 | None | 98.9 | 97 | 1.4 | None |
| Example 35 | 551 | None | 99.4 | 320 | 1.1 | None |
| Example 36 | 501 | None | 99.5 | 250 | 0.9 | None |
| Example 37 | 150 | None | 99.2 | 120 | 1.0 | None |
| Example 38 | 89 | None | 99.3 | 101 | 1.0 | None |
| Example 39 | 51 | None | 99.0 | 99 | 1.1 | None |
| Example 40 | 41 | None | 98.7 | 105 | 1.1 | None |
| Example 41 | 29 | Yes | 85.3 | 132 | 1.0 | None |
| Example 42 | 23 | Yes | 81.0 | 150 | 1.1 | None |
| Example 43 | 55 | Yes | 78.0 | 120 | 1.1 | None |
| Example 44 | 52 | None | 98.1 | 96 | 1.2 | None |
| Example 45 | 57 | None | 99.5 | 92 | 1.1 | None |
| Example 46 | 55 | None | 99.3 | 94 | 1.0 | None |
| Example 47 | 120 | None | 99.5 | 118 | 1.1 | None |
| Example 48 | 150 | None | 99.5 | 125 | 1.1 | None |
| Example 49 | 38 | None | 99.1 | 123 | 1.2 | None |
| Example 50 | 45 | None | 99.5 | 92 | 1.1 | None |
| Example 51 | 53 | None | 99.6 | 93 | 1.0 | None |
| Example 52 | 66 | None | — | — | 1.1 | None |
| Example 53 | 51 | None | 99.8 | 90 | 1.1 | None |
| Example 54 | 52 | None | 99.3 | 73 | 1.0 | None |
| Example 55 | 54 | None | 99.6 | 74 | 0.9 | None |
| Example 56 | 53 | None | 99.4 | 85 | 1.1 | None |

TABLE 2-3-continued

| | Coarse particle retention time (sec) | Over-flow | Yield rate between processes (%) | Process time (min) | 25 μm or more particle rate (Vol %) | Flaking (visual) |
|---|---|---|---|---|---|---|
| Example 57 | 58 | None | 99.7 | 93 | 1.0 | None |
| Example 58 | 52 | None | 99.8 | 93 | 1.2 | None |
| Example 59 | 55 | None | 99.7 | 72 | 1.2 | None |
| Example 60 | 56 | None | 99.4 | 75 | 1.0 | None |
| Example 61 | 53 | None | 99.6 | 91 | 1.2 | None |
| Example 62 | 48 | None | 99.7 | 65 | 1.0 | None |
| Comparative Example 4 | 12 | Yes | 75.1 | 224 | 1.0 | None |
| Comparative Example 5 | 302 | None | 99.5 | 440 | 1.1 | None |
| Comparative Example 6 | 52 | None | 95.5 | 97 | 5.2 | Yes |

Examples 1 to 11 and 32 to 42 prove the guide length L controls retention time of aggregates and coarse particles on the screen 1, and stably sieve with good yield rate.

Examples 12 to 17 and 43 to 48 prove the guide height H change the flow amount, and when a liquid height on the screen 1 rises, the flow amount decreases and the process time tends to be longer.

Further, from Examples 18 to 21 and 49 to 52, the process time proves process efficiency of the flow channel width reduction rate α.

In addition, from Examples 22 to 31 and 53 to 62, the process time and screen removability prove pure water and compressed air efficiently wash the screen 1, depending on an angle of the washing nozzle 6 and a distance thereof.

Comparative Examples 1 and 4 prove materials on the screen 1 stay longer without the guide and flow out to the coarse powder exhaust 3 unprocessed, resulting in low yield rate. Then, the flow amount was reduced so as not to cause overflow, resulting in longer process time. Further, no washing nozzle promoted clogging of the screen 1, resulting in further deterioration of processing capacity.

Comparative Examples 2 and 5 eliminate flowing out of materials to the coarse powder exhaust 3 unprocessed, but aggregates and coarse particles accumulated on the screen 1 to lower the process amount, resulting in longer process time. Clogging of the screen 1 was promoted without a washing nozzle, resulting in further deterioration of processing capacity.

Comparative Examples 3 and 6 have process time equal to when no nozzle was used at high yield rate, but an ultrasonic excitation energy transmitted to the metallic guide 5 caused flaking of material and increase of aggregates due to melted material.

Thus, the present invention provides the oscillation sieve 100 stably sieving wet materials such as toner slurry and dry materials such as toner for long periods without lowering yield rate, processing capacity of screen, flaking and aggregates.

Materials to be sieved by the oscillation sieve of the present invention is not limited to a toner, and include chemical products such as synthetic resins, coatings, pigments, pharmaceuticals and industrial chemicals; foods such as flours, starches, grape sugars, seasoners, spices, confectioneries, breadcrumbs, fine sugars and salts; metallic products such as iron and non-ferrous metallic powders, casting sands, ferrites, aluminum oxides and shot blast balls; and materials in any other fields.

The present invention includes the following embodiments A to F.

Embodiment A

An oscillation sieve 100 including a mesh such as screen 1, an oscillator oscillating the mesh to sieve materials such as a toner, a material feeder feeding the material onto the mesh such as a material entrance 2, a material collector collecting materials having passed the mesh such as a product discharge opening 4, a material exhaust exhausting materials not having passed the mesh therefrom such as a coarse powder exhaust 3, and a spiral guide member fixed on the mesh and formed of an elastic material capable of following the oscillating mesh, guiding materials fed onto the mesh from the materials feeder and not having passed the mesh to the material exhaust such as a guide 5. The mesh is oscillated to sieve materials and aggregates and coarse particles remaining on the mesh are continuously discharged from an exhaust of the oscillation sieve. The spiral guide member formed of an elastic material between the material feeder and the material exhaust on the mesh retaining materials thereon mechanically prevents unsieved materials from flowing out from the material exhaust. Aggregates and coarse particles are continuously discharged while materials are retained on the mesh, and a retaining ratio thereof on the mesh does not increase and do not cause clogging. Therefore, the sieving capacity does not deteriorate even in long-time operation. Further, since the elastic material used for the guide member on the mesh has oscillation absorbability, the guide member on the mesh reduces oscillation of the mesh while retaining materials thereon to prevent materials from tapping between the guide member on the mesh and the mesh and new aggregates caused by the tapping from generating. Further, the guide member on the mesh formed of a material having low density and low hardness prevents the tapping more and materials from flaking. In addition, the guide member formed of a member having low heat conductivity prevents itself from being heated due to friction between the guide member on the mesh and the mesh, which prevents new aggregate from generating due to melted materials.

Embodiment B

In embodiment A, the guide has a length L of from 0.2 to 2.0 times of that of an outer circumference of the screen 1, which controls retention time of aggregates and coarse particles to control properties thereof.

Embodiment C

In embodiment A, the guide has a height H of from 20 to 150 mm. This enables the sieve to sieve more than an amount specified and downsizes the sieve. In addition, the height prevents the sieve from being influenced by oscillation and amplitude and lowering its sieving capacity, and the life of the mesh from reducing.

Embodiment D

In one of the embodiments A to C, the guide 5 is located such the reduction rate α of a flow channel width formed thereby is from 0/50 to 10/50. This gradually narrows the flow channel width from the material entrance 2 to the coarse powder exhaust 3 to effectively use the area of the screen 1. In addition, this prevents aggregates and coarse particles from blocking the flow channel when quickly narrowed.

Embodiment E

In one of the embodiments A to D, a mesh washer washing the surface of the mesh is equipped, which prevents the mesh from clogging and lowering sieving capacity.

Embodiment F

In one of the embodiments A to E, the mesh washer includes a washing nozzle 6 discharging a fluid washing medium. The washing nozzle is located above an outer circumference of the mesh (inner circumferential surface of the upper frame 10) such that washing distance J from the screen 1 to the washing nozzle to the screen 1 is from 50 to 150 mm and a washing angle θ between a discharge direction of the washing medium and the surface of the mesh is from 10 to 45". This washes along movement locus of aggregates and coarse particles to remove them from the mesh and prevents the mesh from being clogged. This prevents the washing efficiency from lowering because the washing nozzle is too close to the mesh or too far therefrom.

Having now fully described the invention, it will be apparent to one of ordinary skill in the art that many changes and modifications can be made thereto without departing from the spirit and scope of the invention as set forth therein.

What is claimed is:

1. An oscillation sieve, comprising:

a screen;

an oscillator configured to oscillate the screen to sieve a material;

a feeder configured to feed the material onto the screen;

a collector configured to collect the material having passed the screen;

a remover configured to remove the material not having passed the screen therefrom;

a guide member fixed on the screen, configured to guide the material fed from the feeder and not having passed the screen to the remover, wherein the guide member is spiral member formed of an elastic material capable of following the oscillating screen, and wherein the elastic material of the guide member includes a foamed material.

2. The oscillation sieve of claim 1, wherein the guide member has a length of from 0.2 to 2.0 times of an outer circumferential length of the screen.

3. The oscillation sieve of claim 1, wherein the guide member has a height of from 20 to 150 mm.

4. The oscillation sieve of claim 1, wherein the guide member is located so as to form a flow channel width having a reduction rate of from 0/50 to 10/50.

5. The oscillation sieve of claim 1, further comprising a screen washer configured to wash the surface of the screen.

6. The oscillation sieve of claim 5, wherein the screen washer comprises a washing nozzle configured to discharge a fluid washing medium and located above an outer circumference of the screen so as to have a washing distance from the washing nozzle to the surface of the screen of from 50 to 150 mm and a washing angle between a discharge direction of the washing medium and the surface of the screen of from 10 to 45°.

7. The oscillation sieve of claim 1, wherein the elastic material is a polyurethane foam, a polyethylene foam, or a polyolefin foam.

8. The oscillation sieve of claim 1, wherein the guide member is a material having oscillation absorbability.

9. An oscillation sieve, comprising:

a screen;

an oscillator configured to oscillate the screen to sieve a material;

a feeder configured to feed the material onto the screen;

a collector configured to collect the material having passed the screen;

a remover configured to remove the material not having passed the screen therefrom;

a fixed-position guide member fixed on the screen and configured to guide the material fed from the feeder and not having passed the screen to the remover, wherein the fixed-position guide member is formed of an elastic material capable of following the oscillating screen while guiding the material from the feeder to the remover, and the elastic material of the fixed-position guide member includes at least one of a natural rubber, a synthetic rubber, a foamed sponge, a foamed material and a plastic foam.

10. The oscillation sieve of claim 9, wherein the fixed-position guide member is a spiral-shaped member.

11. An oscillation sieve, comprising:

a screen;

an oscillator configured to oscillate the screen to sieve a material;

a feeder configured to feed the material onto the screen;

a collector configured to collect the material having passed the screen;

a remover configured to remove the material not having passed the screen therefrom;

a guide member fixed on the screen, configured to guide the material fed from the feeder and not having passed the screen to the remover, wherein the guide member is spiral member formed of an elastic material capable of following the oscillating screen, and wherein the elastic material of the guide member includes a foamed material, wherein the guide member has a length of from 0.2 to 2.0 times of an outer circumferential length of the screen, wherein the guide member has a height of from 20 to 150 mm, and wherein the guide member is located so as to form a flow channel width having a reduction rate of from 0/50 to 10/50.

* * * * *